US009255475B2

(12) United States Patent
Zuo et al.

(10) Patent No.: US 9,255,475 B2
(45) Date of Patent: Feb. 9, 2016

(54) METHODS FOR CHARACTERIZING ASPHALTENE INSTABILITY IN RESERVOIR FLUIDS

(75) Inventors: Youxiang Zuo, Sugar Land, TX (US); Oliver C. Mullins, Ridgefield, CT (US); Chengil Dong, Sugar Land, TX (US); Denise Freed, Newton Highlands, MA (US); Andrew Pomerantz, Lexington, MA (US); Eric Lehne, Edmonton (CA); Dingan Zhang, Edmonton (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 423 days.

(21) Appl. No.: 13/696,780

(22) PCT Filed: Apr. 20, 2011

(86) PCT No.: PCT/IB2011/051740

§ 371 (c)(1),
(2), (4) Date: Jan. 18, 2013

(87) PCT Pub. No.: WO2011/138700

PCT Pub. Date: Nov. 10, 2011

(65) Prior Publication Data

US 2013/0112406 A1 May 9, 2013

Related U.S. Application Data

(60) Provisional application No. 61/332,595, filed on May 7, 2010.

(51) Int. Cl.

| | |
|---|---|
| ***E21B 47/10*** | (2012.01) |
| ***E21B 49/10*** | (2006.01) |
| *E21B 49/08* | (2006.01) |

(52) U.S. Cl.
CPC ..... *E21B 49/10* (2013.01); *E21B 2049/085* (2013.01)

(58) Field of Classification Search
USPC ..... 166/264; 702/6, 11–13
See application file for complete search history.

(56) References Cited

U.S. PATENT DOCUMENTS

| | | | | |
|---|---|---|---|---|
| 4,994,671 | A | 2/1991 | Safinya et al. | |
| 5,504,063 | A * | 4/1996 | Becker et al. | 507/243 |

(Continued)

FOREIGN PATENT DOCUMENTS

| | | | |
|---|---|---|---|
| GB | 2459471 | A | 10/2009 |
| WO | 2009138911 | A2 | 11/2009 |

(Continued)

OTHER PUBLICATIONS

International Search Report for PCT Application Serial No. PCT/IB2011/051740 dated Sep. 19, 2012.

(Continued)

*Primary Examiner* — Taras P Bemko
(74) *Attorney, Agent, or Firm* — Kenneth L. Kincaid

(57) ABSTRACT

A methodology for reservoir understanding that performs investigation of asphaltene instability as a function of location in a reservoir of interest. In the preferred embodiment, results derived as part of the investigation of asphaltene instability are used as a workflow decision point for selectively performing additional analysis of reservoir fluids. The additional analysis of reservoir fluids can verify the presence of asphaltene flocculation onset conditions and/or determine the presence and location of phase-separated bitumen in the reservoir of interest.

34 Claims, 10 Drawing Sheets

(56) References Cited

U.S. PATENT DOCUMENTS

| | | | | |
|---|---|---|---|---|
| 7,081,615 | B2 | 7/2006 | Betancourt et al. | |
| 7,822,554 | B2 | 10/2010 | Zuo et al. | |
| 7,920,970 | B2 | 4/2011 | Zuo et al. | |
| 7,996,154 | B2 | 8/2011 | Zuo et al. | |
| 8,271,248 | B2 | 9/2012 | Pomerantz et al. | |
| 8,805,617 | B2 | 8/2014 | Zuo et al. | |
| 8,825,408 | B2 | 9/2014 | Freed et al. | |
| 8,996,346 | B2 | 3/2015 | Zuo et al. | |
| 2004/0104341 | A1* | 6/2004 | Betancourt et al. | 250/255 |
| 2009/0192768 | A1 | 7/2009 | Zuo et al. | |
| 2009/0235731 | A1 | 9/2009 | Zuo et al. | |
| 2009/0248310 | A1* | 10/2009 | Zuo et al. | 702/11 |
| 2009/0312997 | A1 | 12/2009 | Freed et al. | |
| 2010/0089800 | A1* | 4/2010 | MacDonald et al. | 208/390 |

FOREIGN PATENT DOCUMENTS

| | | | |
|---|---|---|---|
| WO | 2011007268 | A1 | 1/2011 |
| WO | 2011132095 | A2 | 10/2011 |

OTHER PUBLICATIONS

Akbarzadeh, et al. "Asphaltenes—Problematic but Rich in Potential," Oilfield Review, Summer 2007, pp. 22-43.

Almehaideb, et al. "EOS tuning to model full field crude oil properties using multiple well fluid PVT analysis," Journal of Petroleum Science and Engineering, vol. 26, Issues 1-4, pp. 291-300, 2000.

Betancourt, et al. "Predicting Downhole Fluid Analysis Logs to Investigate Reservoir Connectivity," IPTC 11488, International Petroleum Technology Conference, Jan. 1, 2007, pp. 1-11, doi:10.2523/11488-MS.

Diallo, et al. "Chapter 5—Thermodynamic Properties of Asphaltenes: A Predictive Approach Based on Computer Assisted Structure Elucidation and Atomistic Simulations", in book edited by Yen, T.F., and Chingarian, G.V., Asphaltenes and Asphalts. 2. Developments in Petroleum Scienece, 40 B, Elsevier Science B.V., (2000), pp. 103-127.

Hirschberg, et al. "Influence of Temperature and Pressure on Asphaltene Flocculation," Jun. 1984, Society of Petroleum Engineers Journal, 24, pp. 283-293.

Indo, et al. "Asphaltene Nanoaggregates Measured in a Live Crude Oil by Centrifugation," Energy & Fuels, 2009, 23, pp. 4460-4469, DO1:10.1021/ef900369r.

Li "Rapid Flash Calculations for Compositional Simulation," SPE Reservoir Evaluation and Engineering, Oct. 2006, pp. 521-529.

Lohrenz, et al. "Calculating Viscosity of Reservoir Fluids from their Composition," SPE 915, Journal of Petroleum Technology, Oct. 1964, pp. 1171-1176.

Mohammadi, et al. "A Monodisperse Thermodynamic Model for Estimating Asphaltene Precipitation," AlChE Journal, Nov. 2007, vol. 53, No. 11, pp. 2940-2947.

Mullins, et al. "Asphaltene Gravitational Gradient in a Deepwater Reservoir as Determined by Downhole Fluid Analysis," SPE 106375, SPE Conference Paper, 2007, pp. 1-6, doi:10.2118/106375-MS.

Nikookar, et al. "Modification of a thermodynamic model and an equation of state for accurate calculation of asphaltene precipitation phase behavior," Fuel, vol. 87, Issue 1, Jan. 2008, pp. 85-91, DOI: 10.1016/j.fuel.2007.04.002, XP022344851.

Speight, et al. "Molecular Models for Petroleum Asphaltenes and Implications for Asphalt Science and Technology," Proceedings of the International Symposium on the Chemistry of Bitumens, 1991, pp. 154-207.

Ting, et al. "Modeling of Asphaltene Phase Behavior with the SAFT Equation of State," Pet. Sci. Technol. 2003, 21, 16 pages.

Vaidya, et al. "Compressibility of 18 Molecular Organic Solids to 45 kbar," J. Chem. Phys., 55(3), pp. 978-992 (1971), doi: 10.1063/1.1676268.

Vargas, et al. "Development of a General Method for Modeling Asphaltene Stability," Energy Fuels, 2009, 23 (3), pp. 1147-1154, DOI: 10.1021/ef800666j, XP007909590.

Zuo, et al. "A Simple Relation between Solubility Parameters and Densities for Live Reservoir Fluids," J. Chem. Eng. Data, 2010, 55, pp. 2964-2969.

Zuo, et al. "Integration of Fluid Log Predictions and Downhole Fluid Analysis", SPE 122562, presented at 2009 SPE Asia Pacific Oil and Gas Conference and Exhibition held in Jakarta, Indonesia, Aug. 4-6, 2009, pp. 1-11.

Zuo, et al. "Investigation of Formation Connectivity Using Asphaltene Gradient Log Predictions Coupled with Downhole Fluid Analysis", SPE 124264, presented at 2009 SPE Annual Technical Conference and Exhibition held in New Orleans, Louisiana, USA, Oct. 4-7, 2009, pp. 1-11.

Pedersen, et al. "Viscosity of Crude Oils," Chemical Engineering Science, vol. 39, No. 6, pp. 1011-1016, 1984.

* cited by examiner

METHODS FOR CHARACTERIZING ASPHALTENE INSTABILITY IN RESERVOIR FLUIDS

CROSS-REFERENCE TO RELATED APPLICATIONS

The present invention claims priority from U.S. Provisional Patent Application 61/332,595, filed May 7, 2010, incorporated herein by reference in its entirety.

BACKGROUND OF THE INVENTION

1. Field of the Invention

The present invention relates to methods for characterizing petroleum fluids extracted from a hydrocarbon-bearing geological formation. The invention has application to reservoir architecture understanding, although it is not limited thereto.

2. Description of Related Art

Petroleum consists of a complex mixture of hydrocarbons of various molecular weights, plus other organic compounds. The exact molecular composition of petroleum varies widely from formation to formation. The proportion of hydrocarbons in the mixture is highly variable and ranges from as much as 97 percent by weight in the lighter oils to as little as 50 percent in the heavier oils and bitumens. The hydrocarbons in petroleum are mostly alkanes (linear or branched), cycloalkanes, aromatic hydrocarbons, or more complicated chemicals like asphaltenes. The other organic compounds in petroleum typically contain carbon dioxide ($CO_2$), nitrogen, oxygen, and sulfur, and trace amounts of metals such as iron, nickel, copper, and vanadium.

Petroleum is usually characterized by SARA fractionation where asphaltenes are removed by precipitation with a paraffinic solvent and the deasphalted oil separated into saturates, aromatics, and resins by chromatographic separation.

The saturates include alkanes and cycloalkanes. The alkanes, also known as paraffins, are saturated hydrocarbons with straight or branched chains which contain only carbon and hydrogen and have the general formula $C_nH_{2n+2}$. They generally have from 5 to 40 carbon atoms per molecule, although trace amounts of shorter or longer molecules may be present in the mixture. The alkanes include methane ($CH_4$), ethane ($C_2H_6$), propane ($C_3H_8$), i-butane ($iC_4H_{10}$), n-butane ($nC_4H_{10}$), i-pentane ($iC_5H_{12}$), n-pentane ($nC_5H_{12}$), hexane ($C_6H_{14}$), heptane ($C_7H_{16}$), octane ($C_8H_{18}$), nonane ($C_9H_{20}$), decane ($C_{10}H_{22}$), hendecane ($C_{11}H_{24}$)— also referred to as endecane or undecane, dodecane ($C_{12}H_{26}$), tridecane ($C_{13}H_{28}$), tetradecane ($C_{14}H_{30}$), pentadecane ($C_{15}H_{32}$) and hexadecane ($C_{16}H_{34}$). The cycloalkanes, also known as napthenes, are saturated hydrocarbons which have one or more carbon rings to which hydrogen atoms are attached according to the formula $C_nH_{2n}$. Cycloalkanes have similar properties to alkanes but have higher boiling points. The cycloalkanes include cyclopropane ($C_3H_6$), cyclobutane ($C_4H_8$), cyclopentane ($C_5H_{10}$), cyclohexane ($C_6H_{12}$), and cycloheptane ($C_7H_{14}$).

The aromatic hydrocarbons are unsaturated hydrocarbons which have one or more planar six-carbon rings called benzene rings, to which hydrogen atoms are attached with the formula $C_nH_n$. They tend to burn with a sooty flame, and many have a sweet aroma. The aromatic hydrocarbons include benzene ($C_6H_6$) and derivatives of benzene, as well as polyaromatic hydrocarbons.

Resins are the most polar and aromatic species present in the deasphalted oil and, it has been suggested, contribute to the enhanced solubility of asphaltenes in crude oil by solvating the polar and aromatic portions of the asphaltenic molecules and aggregates.

Asphaltenes are insoluble in n-alkanes (such as n-pentane or n-heptane) and soluble in toluene. The C:H ratio is approximately 1:1.2, depending on the asphaltene source. Unlike most hydrocarbon constituents, asphaltenes typically contain a few percent of other atoms (called heteroatoms), such as sulfur, nitrogen, oxygen, vanadium, and nickel. Heavy oils and tar sands contain much higher proportions of asphaltenes than do medium-API oils or light oils. Condensates are virtually devoid of asphaltenes. As far as asphaltene structure is concerned, experts agree that some of the carbon and hydrogen atoms are bound in ring-like, aromatic groups, which also contain the heteroatoms. Alkane chains and cyclic alkanes contain the rest of the carbon and hydrogen atoms and are linked to the ring groups. Within this framework, asphaltenes exhibit a range of molecular weight and composition. Asphaltenes have been shown to have a distribution of molecular weight in the range of 300 to 1400 g/mol with an average of about 750 g/mol. This is compatible with a molecule contained seven or eight fused aromatic rings, and the range accommodates molecules with four to ten rings.

It is also known that asphaltene molecules aggregate to form nanoaggregates and clusters. The aggregation behavior depends on the solvent type. Laboratory studies have been conducted with asphaltene molecules dissolved in a solvent such as toluene. At extremely low concentrations (below $10^{-4}$ mass fraction), asphaltene molecules are dispersed as a true solution. At higher concentrations (on the order of $10^{-4}$ mass fraction), the asphaltene molecules stick together to form nanoaggregates. These nanoaggregates are dispersed in the fluid as a nanocolloid, meaning the nanometer-sized asphaltene particles are stably suspended in the continuous liquid phase solvent. At even higher concentrations (on the order of $5\times10^{-3}$ mass fraction), the asphaltene nanoaggregates form clusters that remain stable as a colloid suspended in the liquid phase solvent. At higher concentrations (on the order of $5\times10^{-2}$ mass fraction), the asphaltene clusters flocculate to form clumps (or floccules) which are no longer in a stable colloid and precipitate out of the toluene solvent. In crude oil, asphaltenes exhibit a similar aggregation behavior. However, at the higher concentrations (on the order of $5\times10^{-2}$ mass fraction) that cause asphaltene clusters to flocculate in toluene, stability can continue such that the clusters form a stable viscoelastic network in the crude oil. At even higher concentrations, the asphaltene clusters flocculate to form clumps (or floccules) which are no longer in a stable colloid and precipitate out of the crude oil.

Computer-based modeling and simulation techniques have been developed for estimating the properties and/or behavior of petroleum fluid in a reservoir of interest. Typically, such techniques employ an equation of state (EOS) model that represents the phase behavior of the petroleum fluid in the reservoir. Once the EOS model is defined, it can be used to compute a wide array of properties of the petroleum fluid of the reservoir, such as: gas-oil ratio (GOR) or condensate-gas ratio (CGR), density of each phase, volumetric factors and compressibility, heat capacity, and saturation pressure (bubble or dew point). Thus, the EOS model can be solved to obtain saturation pressure at a given temperature. Moreover, GOR, CGR, phase densities, and volumetric factors are byproducts of the EOS model. Transport properties, such as heat capacity or viscosity, can be derived from properties obtained from the EOS model, such as fluid composition. Furthermore, the EOS model can be extended with other reservoir evaluation techniques for compositional simulation of flow and production behavior of the petroleum fluid of the reservoir, as is well known in the art. For example, compositional simulations can be helpful in studying (1) depletion of a volatile oil or gas condensate reservoir where phase compositions and properties vary significantly with pressure below bubble or dew point pressures, (2) injection of non-equilibrium gas (dry or enriched) into a black oil reservoir to mobilize oil by vaporization into a more mobile gas phase or by condensation through an outright (single contact) or dynamic (multiple contact) miscibility, and (3) injection of $CO_2$ into an oil reservoir to mobilize oil by miscible displacement and by oil viscosity reduction and oil swelling.

In the past few decades, fluid homogeneity in a hydrocarbon reservoir has been assumed. However, there is now a growing awareness that fluids are often heterogeneous or compartmentalized in the reservoir. A compartmentalized reservoir consists of two or more compartments that effectively are not in hydraulic communication. Two types of reservoir compartmentalization have been identified, namely vertical and lateral compartmentalization. Vertical compartmentalization usually occurs as a result of faulting or stratigraphic changes in the reservoir, while lateral compartmentalization results from barriers to horizontal flow. Molecular and thermal diffusion, natural convection, biodegradation, adsorption, and external fluxes can also lead to non-equilibrium hydrocarbon distribution in a reservoir. Reservoir compartmentalization can significantly hinder production and can make the difference between an economically viable field and an economically nonviable field. Techniques to aid an operator to accurately describe reservoir compartments and their distribution can increase understanding of such reservoirs and ultimately raise production.

Asphaltene-rich oils can accumulate by precipitation of asphaltenes from oil and form bitumen in the reservoir. Bitumen is very heavy in nature and therefore relatively immobile in the reservoir. Oil can be produced from bitumen utilizing thermally enhanced recovery, such as steam injection and solvent injection. For these methods, early detection of the bitumen and proper well placement is important. Bitumen has a high viscosity and acts as a permeability barrier (sometimes referred to as a tar mat). Tar mats are often observed near the oil-water contact. Tar mats effectively isolate the oil column from the underlying aquifer. In such fields, injection wells are often needed for effective oil recovery. These injection wells are best placed within a narrow depth interval above the tar mat to minimize the oil trapped under the injectors.

Thus, the identification of bitumen deposits in a reservoir is also important for reservoir assessment since it may help to assess the producible reserves and oil recovery. More specifically, such analysis can help an operator better understand the mechanism of formation of the bitumen deposit and the locations and intervals with conditions favorable for bitumen formation. It can also help the operator avoid production processes that might cause precipitation of asphaltenes during production (such as gas injection and pressure reduction).

Identification of the presence of bitumen in a reservoir typically requires the collection and evaluation of core samples from depths where bitumen is suspected. However, it can be difficult to identify the suspected locations for bitumen. Thus, it is often necessary to collect and evaluate a large number of core samples from suspected depths, which can lead to significant costs and inefficiencies arising from the coring and testing operations before the presence of the bitumen is known.

BRIEF SUMMARY OF THE INVENTION

The problems of the prior art are solved by the present invention, which is a method for reservoir assessment that allows for detection of conditions that lead to phase-separated bitumen formation and thus predict the presence of phase-separated bitumen in the reservoir. Advantageously, the method of the present invention allows for efficient identification of the presence of phase-separated bitumen in the reservoir, and thus can lead to optimizations and efficiencies in the development of the reservoir.

The method of reservoir assessment of the present invention can also be integrated into a workflow for investigating reservoir compartmentalization and other reservoir characteristics.

In accord with one embodiment, the method of the present invention investigates instability of an asphaltene fraction in the reservoir fluids in order to predict the presence of phase-separated bitumen in the reservoir. The method of the present invention employs a downhole fluid analysis tool to obtain and perform downhole fluid analysis of live oil samples at multiple measurement stations within a wellbore traversing a reservoir of interest. The downhole fluid analysis is used to derive properties (including concentration of an asphaltene fraction) of the petroleum fluid of the reservoir as a function of location in the reservoir. The method of the invention also derives values of a first parameter that characterizes solubility of the petroleum fluid for different locations or pressures in the reservoir and values of a second parameter characterizing fluid properties of the petroleum fluid for different locations or pressures in the reservoir. The values of the second parameter are based upon concentration of the asphaltene fraction derived from downhole fluid analysis. The values of the first and second parameters are evaluated to identify the reservoir location where the onset of flocculation of the asphaltene fraction, if any, is likely. As the flocculation of asphaltene is typically a precursor to the formation of phase-separated bitumen, this analysis can effectively predict whether it is likely that phase-separated bitumen is present in the reservoir.

In the preferred embodiment, the evaluation of the first and second parameters is part of a workflow decision point for selectively performing additional analysis of reservoir fluids. Such additional analysis can include laboratory fluid analysis (or downhole fluid analysis) that verifies that onset of flocculation of the asphaltene fraction is likely at the reservoir location identified by the evaluation. It can also include core sampling and/or laboratory analysis of core samples that verifies the presence and the location of phase-separated bitumen in the reservoir.

In the preferred embodiment, the concentration of the asphaltene fraction as a function of location in the reservoir is derived from a Flory-Huggins-Zuo type equation of state model that characterizes relative concentration of a set of one or more high molecular weight components as a function of depth as related to relative solubility, density, and molar volume of the high molecular weight components of the set at varying depth. The equation of state model treats the reservoir fluid as a mixture of two parts, the two parts being a solute part and a solvent part. The solute part includes the set of high molecular weight component(s). The solvent part is the bulk reservoir fluid. The high molecular weight component(s) of the solute part preferably include asphaltene clusters and are more preferably selected from the group including resins, asphaltene nanoaggregates, and asphaltene clusters. Preferred embodiments of such models are set forth in detail below.

In the preferred embodiment, the first parameter characterizes solubility of the bulk reservoir fluid at a given location, and the value of the first parameter for a given location is calculated from the density of the bulk reservoir fluid at the given location.

In the preferred embodiment, the second parameter characterizes solubility of the bulk reservoir fluid at the onset of flocculation of the asphaltene fraction at a given location, and the value of the second parameter for a given location is based upon a number of predetermined properties of the reservoir fluid at the given location, the predetermined properties including the volume fraction of the asphaltene fraction, the partial molar volume of the asphaltene fraction, and the molar volume of the bulk reservoir fluid. Most preferably, the value of the second parameter for the given location is derived from the relation $$\delta_{m,onset} = \delta_a - \left\{-\frac{RT}{v_a}\left[\ln\phi_a + 1 - \left(\frac{v_a}{v_m}\right)\right]\right\}^{1/2},$$

where $\phi_a$ is the volume fraction of the asphaltene fraction at the given location, $\upsilon_a$ is the partial molar volume for the asphaltene fraction at the given location, $\upsilon_m$ is the molar volume for the bulk reservoir fluid at the given location, $\delta_a$ is the solubility parameter for the asphaltene fraction at the given location, R is the universal gas constant, and T is the absolute temperature of the reservoir fluid.

In the preferred embodiment, the evaluation identifies the reservoir location where the onset of flocculation of the asphaltene fraction is likely as the location where the values of the first and second parameters satisfy a predetermined condition, such as where the value of the first parameter matches the value of the second parameter.

In an alternate embodiment, the evaluation identifies the reservoir location where the onset of flocculation of the asphaltene fraction is likely based upon the first and second parameters and a third parameter that characterizes fluid properties of the petroleum fluid for different locations or pressures in the reservoir. In this alternate embodiment, it is preferable that the first parameter characterizes solubility of the bulk reservoir fluid, the second parameter characterizes concentration of the asphaltene fraction of the reservoir fluid, and the third parameter characterizes GOR of the reservoir fluid. Moreover, in this alternate embodiment, it is preferred that the evaluation identifies the reservoir location where the onset of flocculation of the asphaltene fraction is likely as the location where the values of the first, second, and third parameters satisfy a predetermined condition, such as where the value of the first parameter (bulk fluid solubility) is small, the value of the second parameter (asphaltene concentration) provides an indication that asphaltenes are present in the oil mixture, and the value of the third parameter (GOR) provides an indication of liquid oil.

Additional objects and advantages of the invention will become apparent to those skilled in the art upon reference to the detailed description taken in conjunction with the provided figures.

DETAILED DESCRIPTION OF THE INVENTION

Figure 1A:
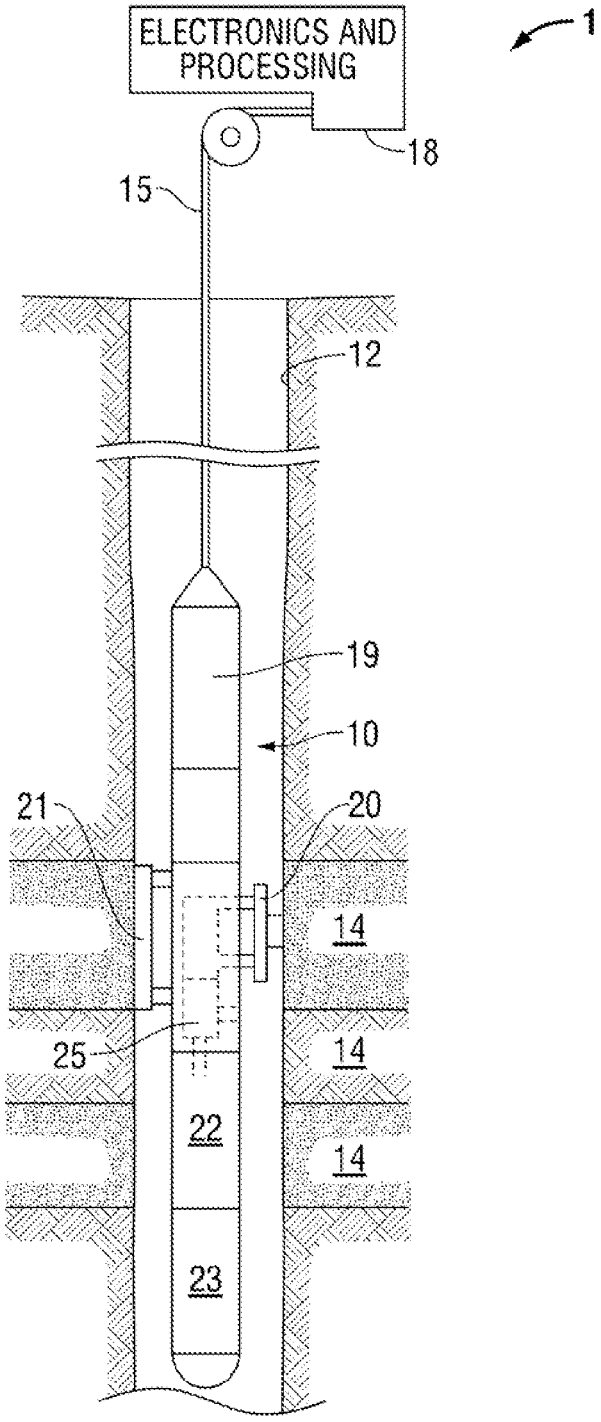
FIG. 1A is a schematic diagram of an exemplary petroleum reservoir analysis system in which the present invention is embodied.

FIG. 1A illustrates an exemplary petroleum reservoir analysis system 1 in which the present invention is embodied. The system 1 includes a borehole tool 10 suspended in the borehole 12 from the lower end of a typical multiconductor cable 15 that is spooled in a usual fashion on a suitable winch on the formation surface. The cable 15 is electrically coupled to an electrical control system 18 on the formation surface. The borehole tool 10 includes an elongated body 19 which carries a selectively extendable fluid admitting assembly 20 and a selectively extendable tool anchoring member 21 which are respectively arranged on opposite sides of the tool body 19. The fluid admitting assembly 20 is equipped for selectively sealing off or isolating selected portions of the wall of the borehole 12 such that fluid communication with the adjacent earth formation 14 is established. The fluid admitting assembly 20 and borehole tool 10 include a flowline leading to a fluid analysis module 25. The formation fluid obtained by the fluid admitting assembly 20 flows through the flowline and through the fluid analysis module 25. The fluid may thereafter be expelled through a port or it may be sent to one or more fluid collecting chambers 22 and 23 which may receive and retain the fluids obtained from the formation. With the fluid admitting assembly 20 sealingly engaging the formation 14, a short rapid pressure drop can be used to break the mudcake seal. Normally, the first fluid drawn into the borehole tool 10 will be highly contaminated with mud filtrate. As the borehole tool 10 continues to draw fluid from the formation 14, the area near the fluid admitting assembly 20 cleans up and reservoir fluid becomes the dominant constituent. The time required for cleanup depends upon many parameters, including formation permeability, fluid viscosity, the pressure difference between the borehole and the formation, and overbalanced pressure difference and its duration during drilling. Increasing the pump rate can shorten the cleanup time, but the rate must be controlled carefully to preserve formation pressure conditions.

The fluid analysis module 25 includes means for measuring the temperature and pressure of the fluid in the flowline. The fluid analysis module 25 derives properties that characterize the formation fluid sample at the flowline pressure and temperature. In the preferred embodiment, the fluid analysis module 25 measures absorption spectra and translates such measurements into concentrations of several alkane components and groups in the fluid sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group, the lump of hexane and heavier alkane components (C6+), and asphaltene content. The C3-C5 alkane group includes propane, butane, and pentane. The C6+ alkane group includes hexane ($C_6H_{14}$), heptane ($C_7H_{16}$), octane ($C_8H_{18}$), nonane ($C_9H_2O$), decane ($C_{10}H_{22}$), hendecane ($C_{11}H_{24}$)—also referred to as endecane or undecane, dodecane ($C_{12}H_{26}$), tridecane ($C_{13}H_{28}$), tetradecane ($C_{14}H_{30}$), pentadecane ($C_{15}H_{32}$), hexadecane ($C_{16}H_{34}$), etc. The fluid analysis module 25 also measures live fluid density ($\rho$) at the flowline temperature and pressure, live fluid viscosity ($\mu$) at flowline temperature and pressure (in cp), formation pressure, and formation temperature.

Control of the fluid admitting assembly 20 and fluid analysis module 25, and the flow path to the collecting chambers 22, 23 is maintained by the electrical control system 18. As will be appreciated by those skilled in the art, the fluid analysis module 25 and the surface-located electrical control system 18 include data processing functionality (e.g., one or more microprocessors, associated memory, and other hardware and/or software) to implement the invention as described herein. The electrical control system 18 can also be realized by a distributed data processing system wherein data measured by the borehole tool 10 is communicated (preferably in real-time) over a communication link (typically a satellite link) to a remote location for data analysis as described herein. The data analysis can be carried out on a workstation or other suitable data processing system (such as a computer cluster or computing grid).

Formation fluids sampled by the borehole tool 10 may be contaminated with mud filtrate. That is, the formation fluids may be contaminated with the filtrate of a drilling fluid that seeps into the formation 14 during the drilling process. Thus, when fluids are withdrawn from the formation 14 by the fluid admitting assembly 20, they may include mud filtrate. In some examples, formation fluids are withdrawn from the formation 14 and pumped into the borehole 12 or into a large waste chamber in the borehole tool 10 until the fluid being withdrawn becomes sufficiently clean. A clean sample is one where the concentration of mud filtrate in the sample fluid is acceptably low so that the fluid substantially represents native (i.e., naturally occurring) formation fluids. In the illustrated example, the borehole tool 10 is provided with fluid collecting chambers 22 and 23 to store collected fluid samples.

The system of FIG. 1A is adapted to make in-situ determinations regarding hydrocarbon-bearing geological formations by downhole sampling of reservoir fluid at one or more measurement stations within the borehole 12, conducting downhole fluid analysis of one or more reservoir fluid samples for each measurement station (including compositional analysis such as estimating concentrations of a plurality of compositional components of a given sample and other fluid properties), and relating the downhole fluid analysis to an equation of state (EOS) model of the thermodynamic behavior of the fluid in order to characterize the reservoir fluid at different locations within the reservoir. With the reservoir fluid characterized with respect to its thermodynamic behavior, fluid production parameters, transport properties, and other commercially useful indicators of the reservoir can be computed.

For example, the EOS model can provide the phase envelope that can be used to interactively vary the rate at which samples are collected in order to avoid entering the two-phase region. In other example, the EOS model can provide useful properties in assessing production methodologies for the particular reservoir. Such properties can include density, viscosity, and volume of gas formed from a liquid after expansion to a specified temperature and pressure. The characterization of the fluid sample with respect to its thermodynamic model can also be used as a benchmark to determine the validity of the obtained sample, whether to retain the sample, and/or whether to obtain another sample at the location of interest. More particularly, based on the thermodynamic model and information regarding formation pressures, sampling pressures, and formation temperatures, if it is determined that the fluid sample was obtained near or below the bubble line of the sample, a decision may be made to jettison the sample and/or to obtain a sample at a slower rate (i.e., a smaller pressure drop) so that gas will not evolve out of the sample. Alternatively, because knowledge of the exact dew point of a retrograde gas condensate in a formation is desirable, a decision may be made, when conditions allow, to vary the pressure drawdown in an attempt to observe the liquid condensation and thus establish the actual saturation pressure.

Figure 1B:
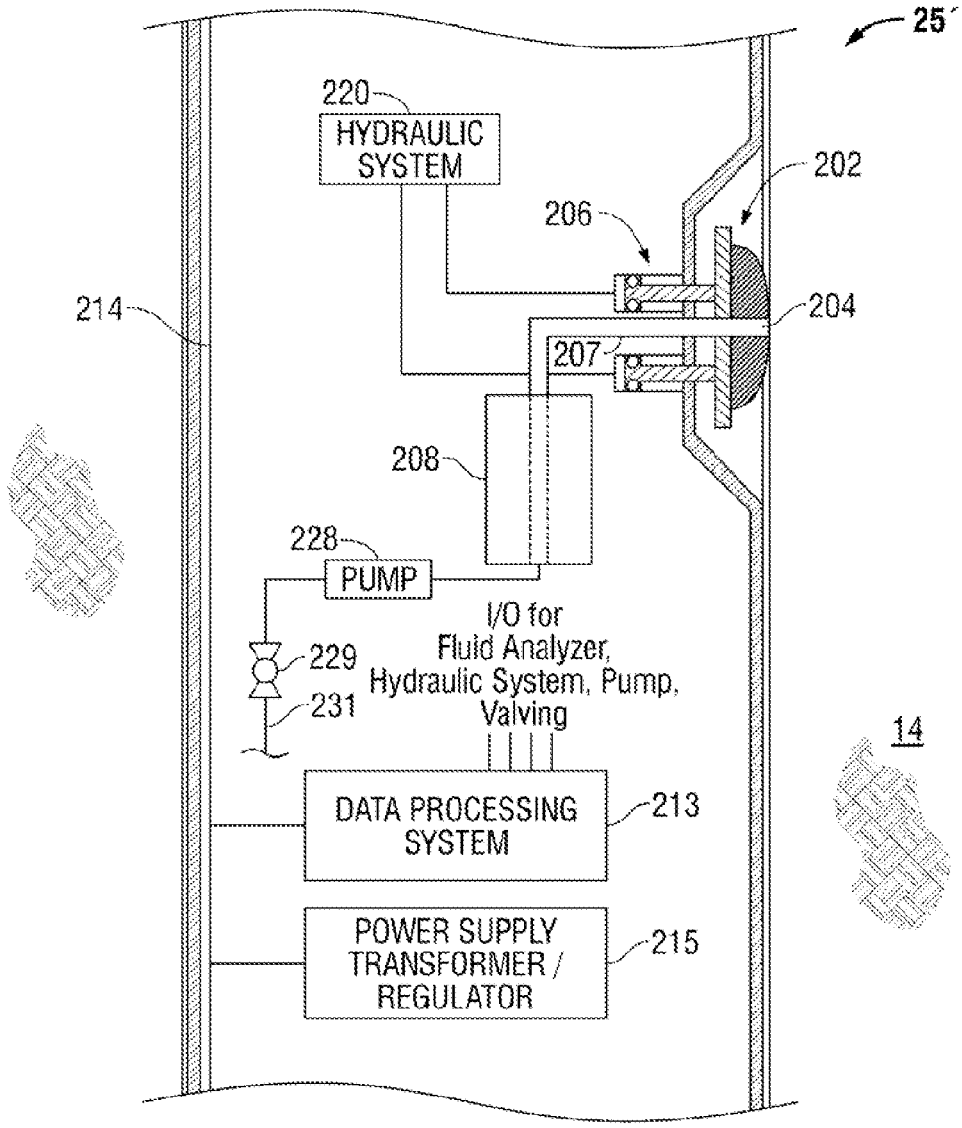
FIG. 1B is a schematic diagram of an exemplary fluid analysis module suitable for use in the borehole tool of FIG. 1A.
Figure 2A:
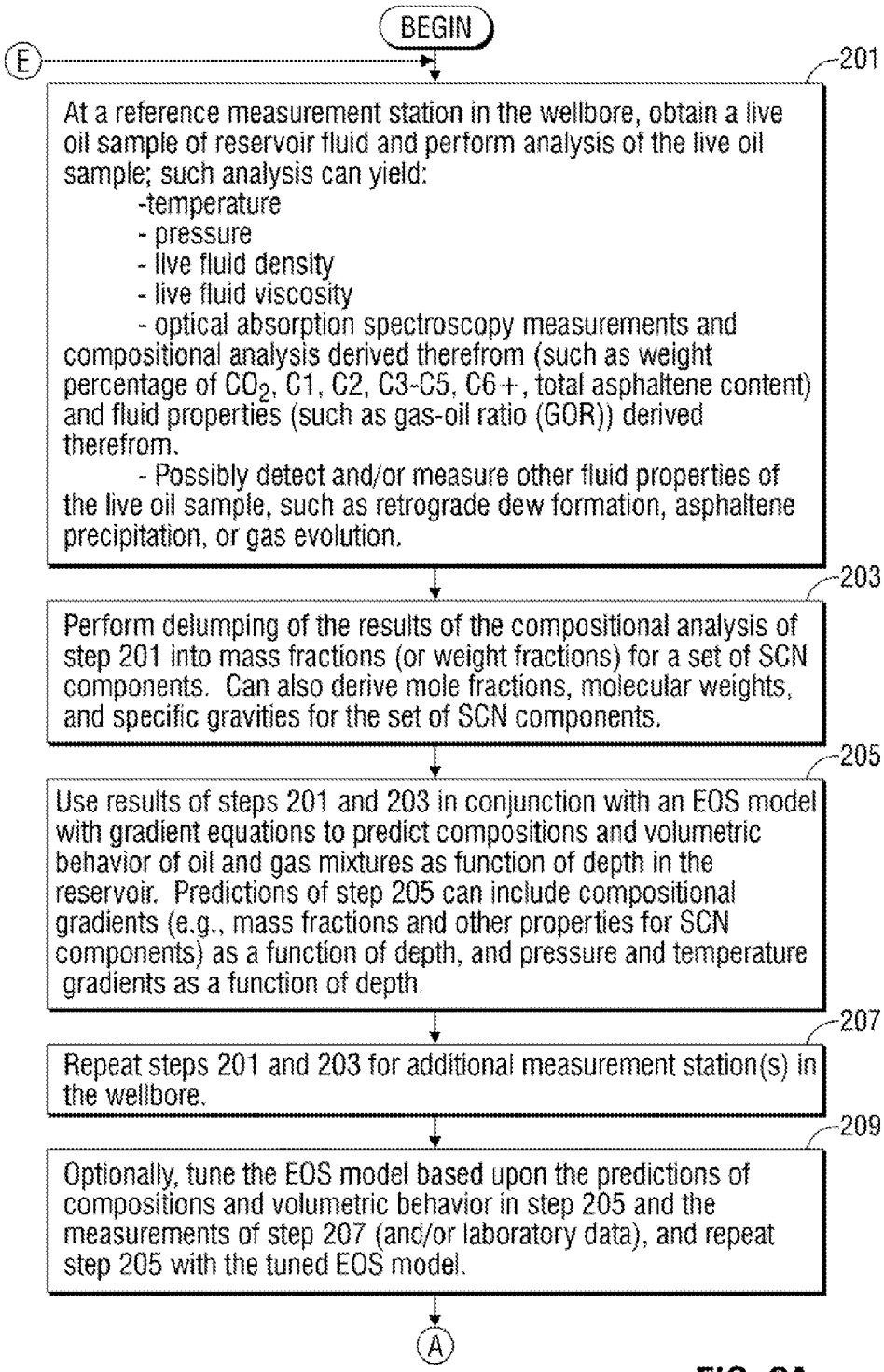
FIGS. 2A-2D, collectively, are a flow chart of data analysis operations that include downhole fluid measurements at a number of different measurement stations within a wellbore traversing a reservoir or interest in conjunction with derivation and analysis of concentration gradients of a high molecular weight fraction of the reservoir fluids. The concentration gradients are generated by a Flory-Huggins-Zuo type equation of state model that characterizes relative concentrations of a set of high molecular weight components as a function of depth as related to relative solubility, density, and molar volume of the high molecular weight components of the set at varying depth.
Figure 2B:
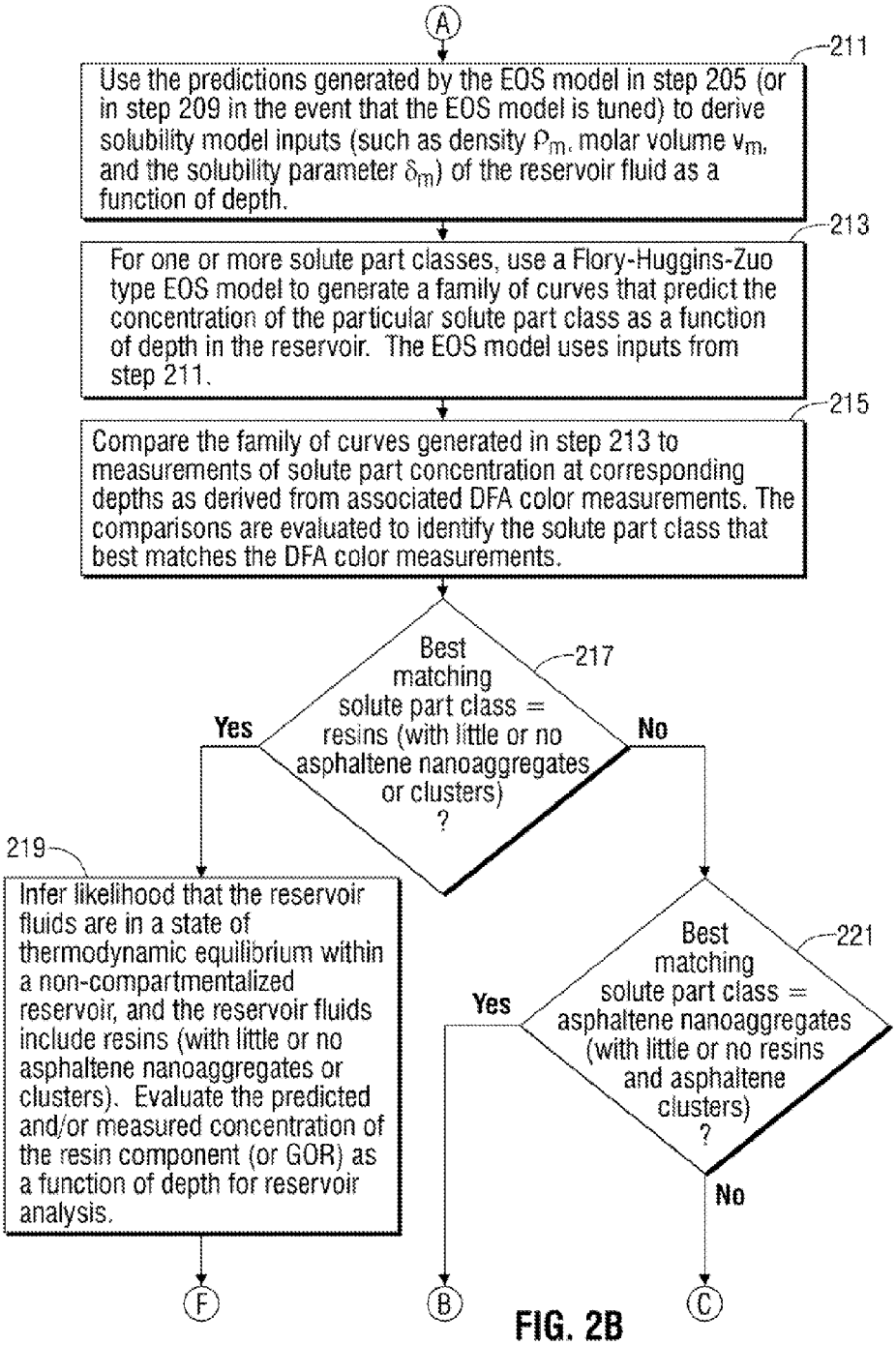
Figure 2C:
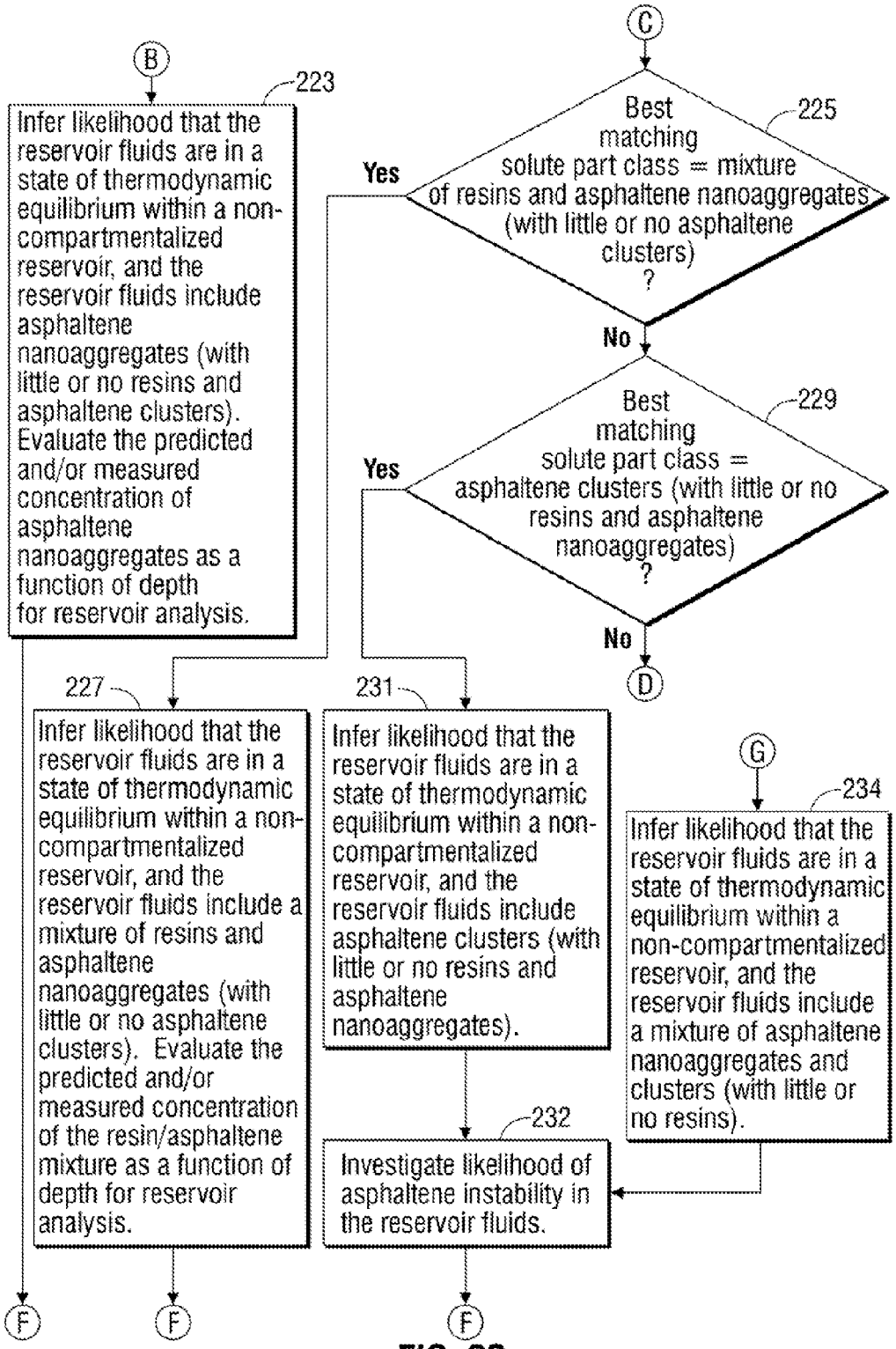
Figure 2D:
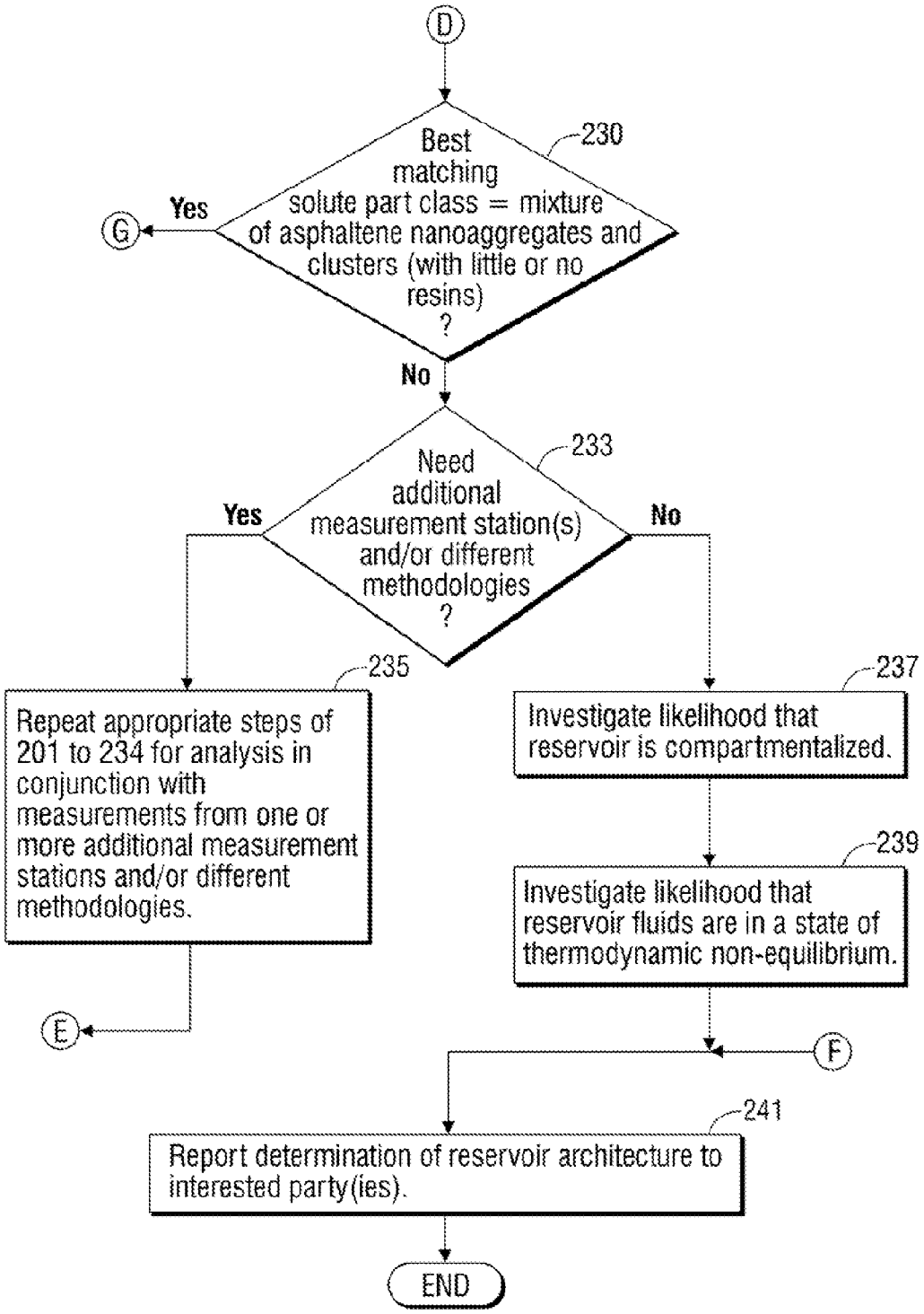
Figure 3A:
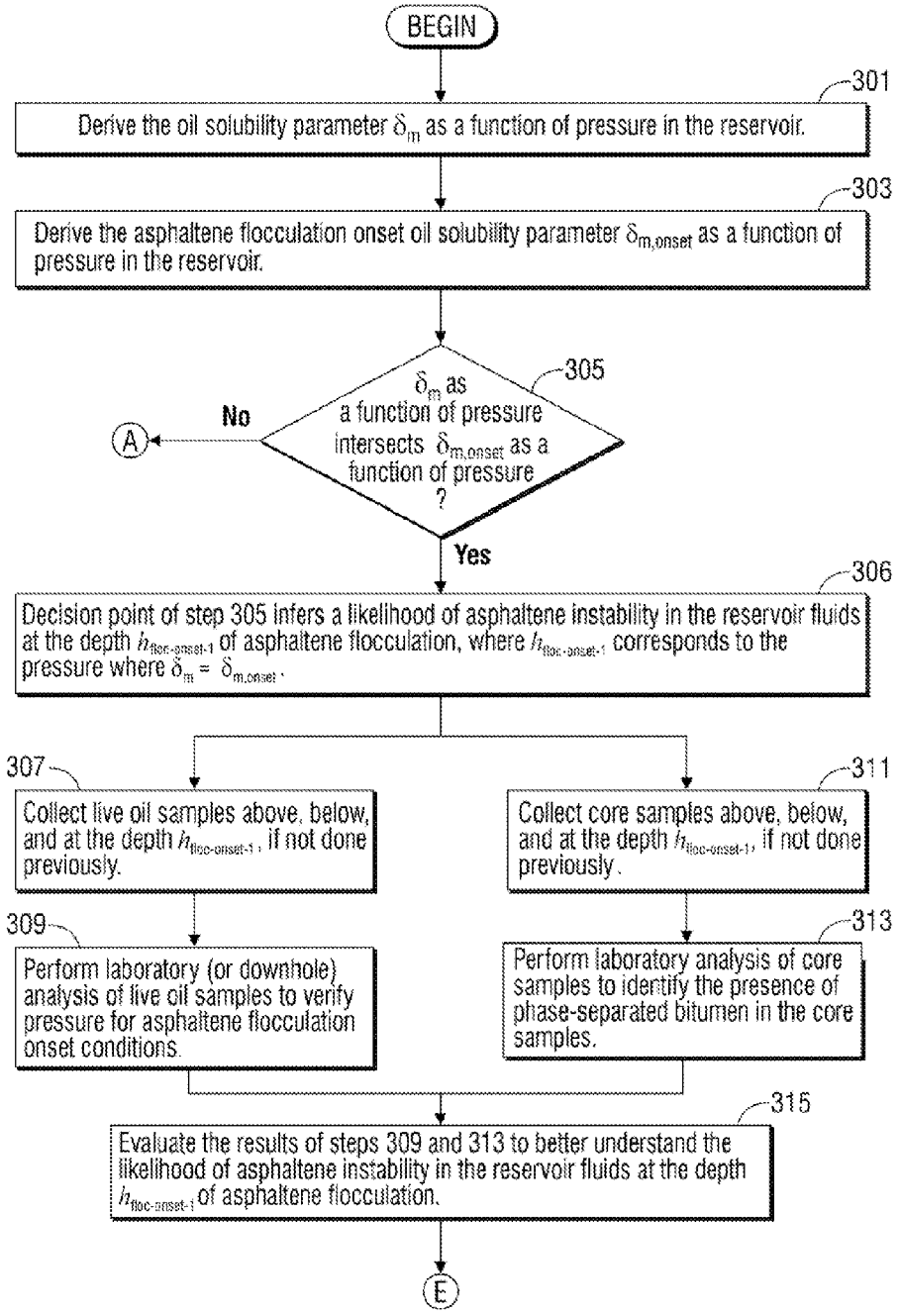
FIGS. 3A-3D, collectively, are a flow chart of data analysis operations that are carried out to investigate asphaltene instability in the reservoir fluids.
Figure 3B:
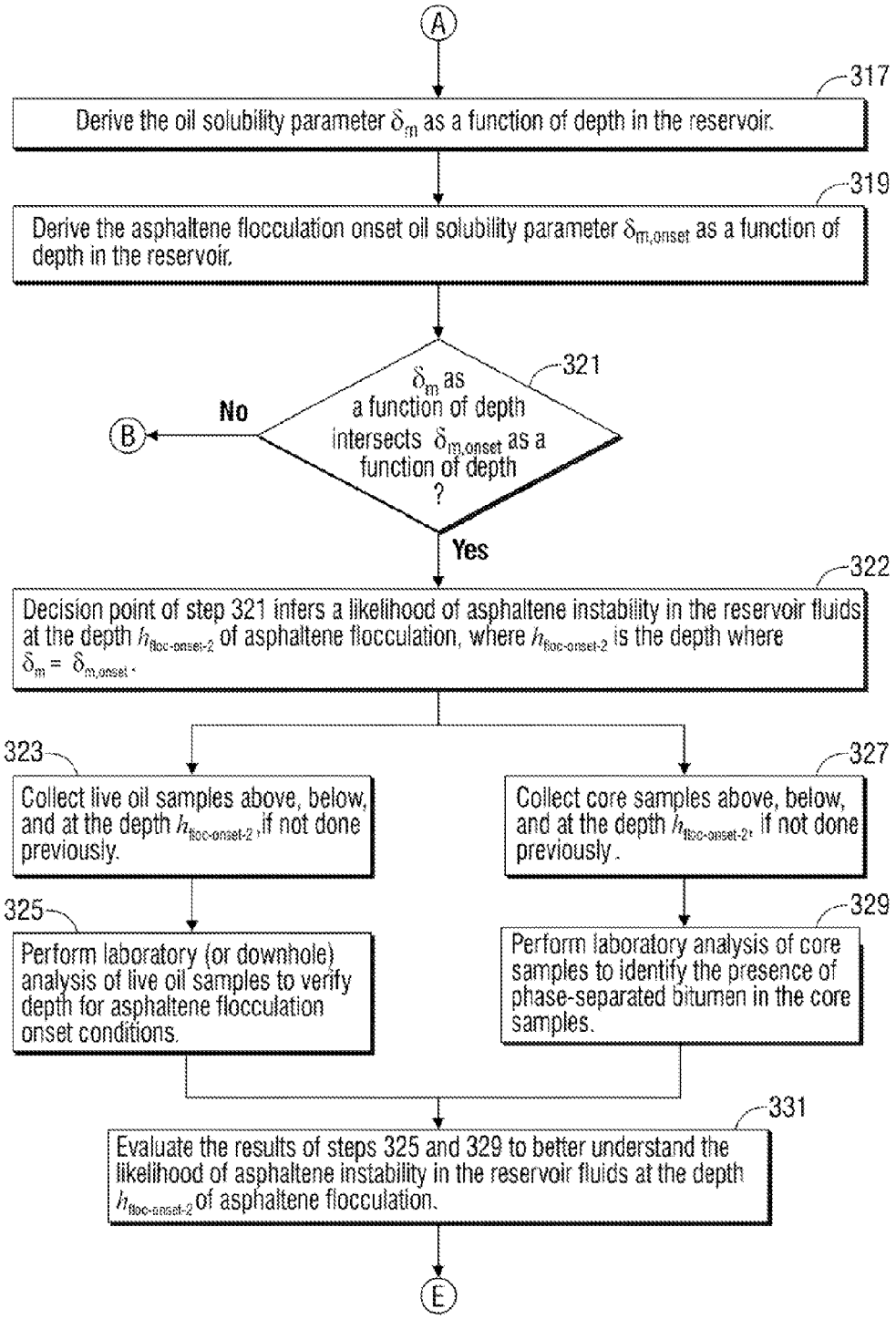
Figure 3C:
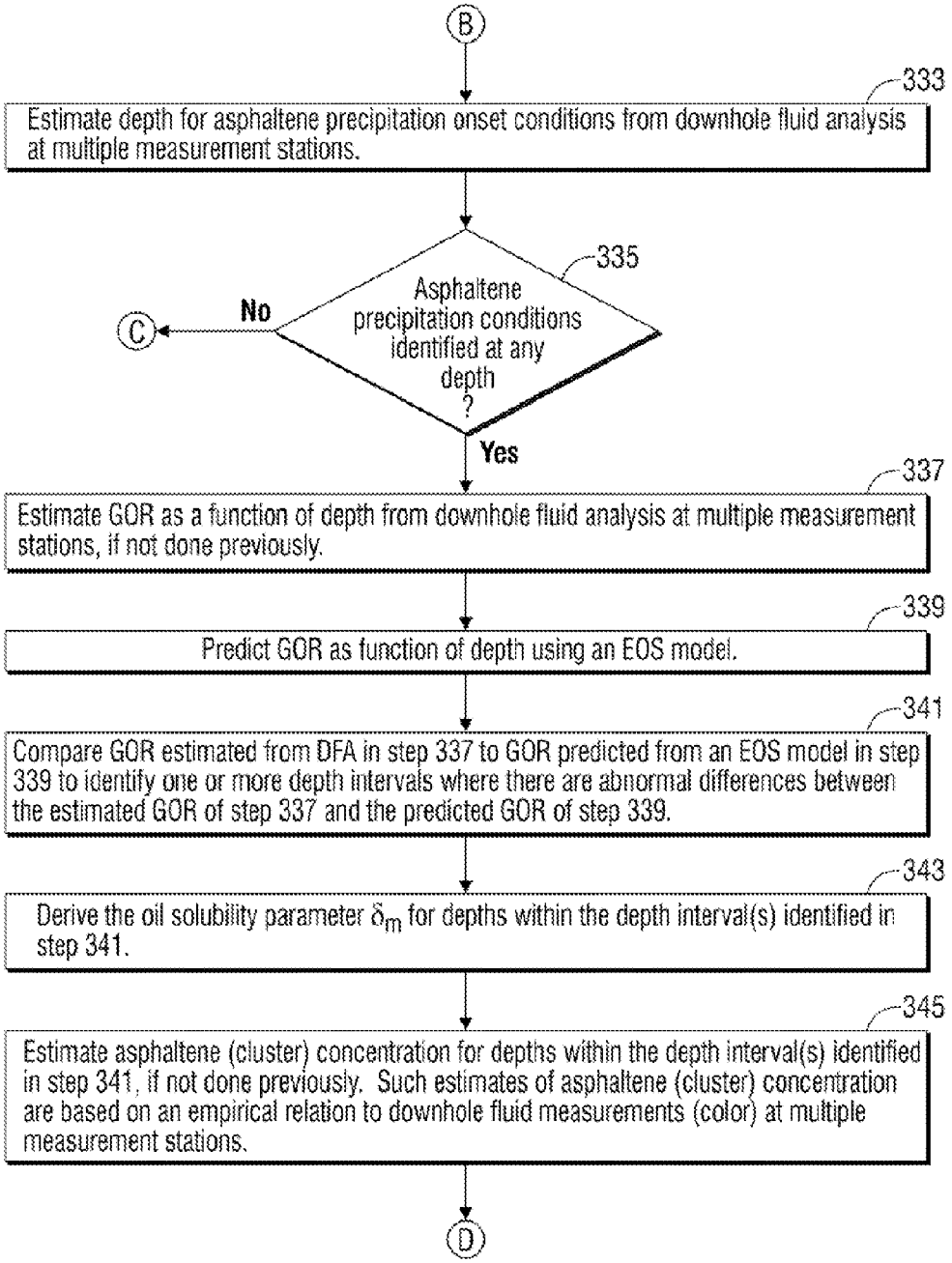
Figure 3D:
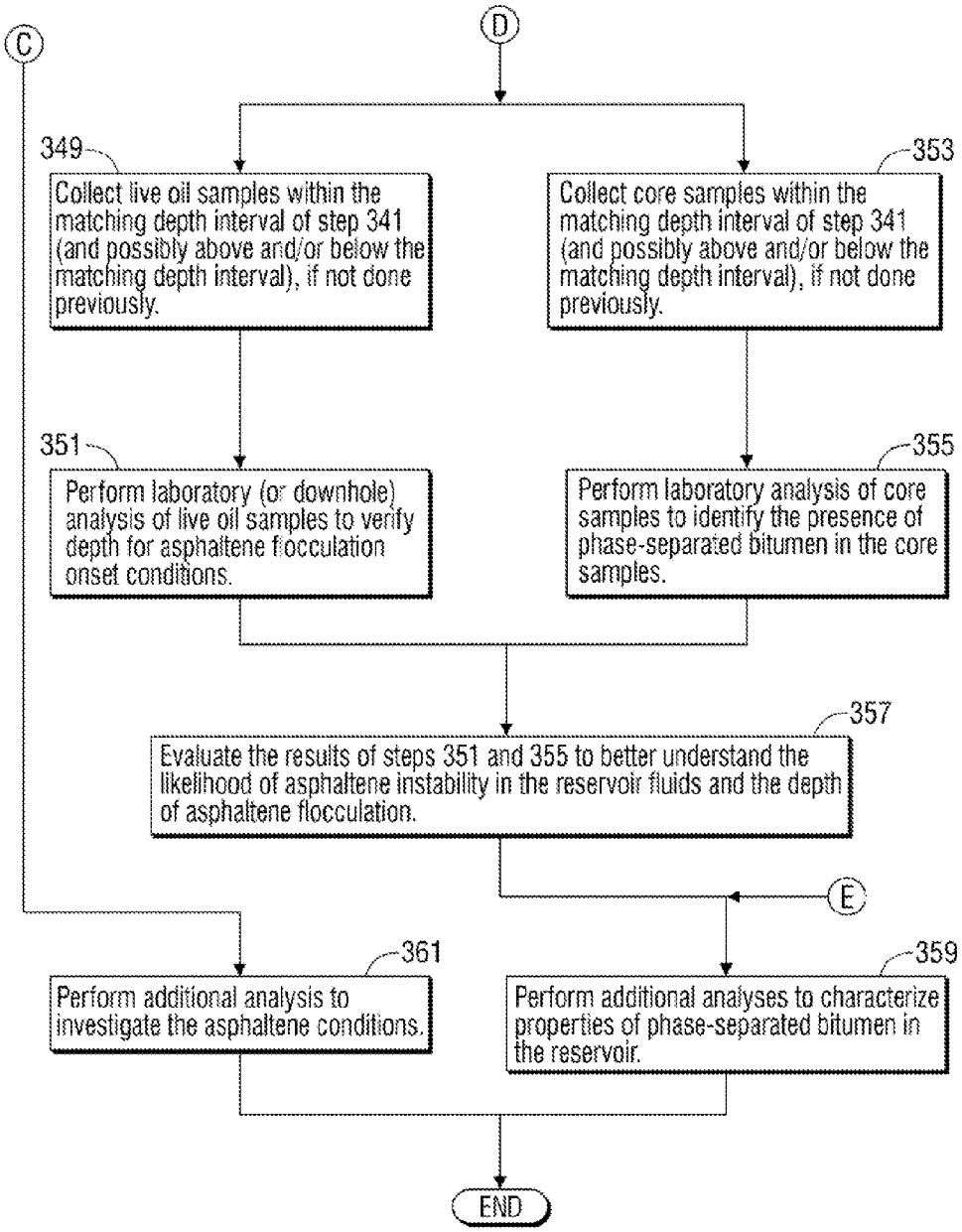

FIG. 1B illustrates an exemplary embodiment of the fluid analysis module 25 of FIG. 1A (labeled 25'), including a probe 202 having a port 204 to admit formation fluid therein. A hydraulic extending mechanism 206 may be driven by a hydraulic system 220 to extend the probe 202 to sealingly engage the formation 14. In alternative implementations, more than one probe can be used or inflatable packers can replace the probe(s) and function to establish fluid connections with the formation and sample fluid samples.

The probe 202 can be realized by the Quicksilver Probe available from Schlumberger Technology Corporation of Sugar Land, Tex., USA. The Quicksilver Probe divides the fluid flow from the reservoir into two concentric zones, a central zone isolated from a guard zone about the perimeter of the central zone. The two zones are connected to separate flowlines with independent pumps. The pumps can be run at different rates to exploit filtrate/fluid viscosity contrast and permeability anistrotropy of the reservoir. Higher intake velocity in the guard zone directs contaminated fluid into the guard zone flowline, while clean fluid is drawn into the central zone. Fluid analyzers analyze the fluid in each flowline to determine the composition of the fluid in the respective flowlines. The pump rates can be adjusted based on such compositional analysis to achieve and maintain desired fluid contamination levels. The operation of the Quicksilver Probe efficiently separates contaminated fluid from cleaner fluid early in the fluid extraction process, which results in the obtaining clean fluid in much less time compared to traditional formation testing tools.

The fluid analysis module 25' includes a flowline 207 that carries formation fluid from the port 204 through a fluid analyzer 208. The fluid analyzer 208 includes a light source that directs light to a sapphire prism disposed adjacent the flowline fluid flow. The reflection of such light is analyzed by a gas refractometer and dual fluoroscene detectors. The gas refractometer qualitatively identifies the fluid phase in the flowline. At the selected angle of incidence of the emitted light, the reflection coefficient is much larger when gas is in contact with the window than when oil or water is in contact with the window. The dual fluoroscene detectors detect free gas bubbles and retrograde liquid dropout to accurately detect single phase fluid flow in the flowline 207. Fluid type is also identified. The resulting phase information can be used to define the difference between retrograde condensates and volatile oils, which can have similar GORs and live oil densities. It can also be used to monitor phase separation in real-time and ensure single phase sampling.

The fluid analyzer 208 can also be arranged to measure the pressure for asphaltene precipitation onset conditions where dissolved asphaltene molecules begin to precipitate from the reservoir fluids in the form of asphaltene nanoaggregates and/or asphaltene clusters (depending on the concentration of the asphaltenes). In the preferred embodiment, the fluid analyzer 208 employs a flowline for isolating a sample of reservoir fluid therein. A piston alters the effective volume and thus the pressure of the fluid sample isolated in the flowline. A pressure sensor measures the pressure of the fluid sample isolated in the flowline. As the pressure is varied, fluorescence (or the transmittance power) of light directed into the fluid sample is measured by one or more detectors. When the asphaltene precipitates are formed, they scatter light and reduce the fluorescence (or transmittance power) of the detected light. Thus, a drop in the fluorescence (or transmittance power) of the detected light provides an indication of asphaltene precipitation onset conditions where dissolved asphaltene molecules begin to precipitate from the reservoir fluids. Such precipitation occurs within a regime commonly referred to as the asphaltene precipitation envelope (APE). Within the APE, the amount of precipitated asphaltene generally increases as the pressure decreases, and reaches a maximum at the bubble point pressure. The pressure-temperature line delineating the asphaltene precipitation conditions above the bubble point is called the upper boundary of the APE. As the pressure continues to decrease below the bubble point pressure, solution gas is removed from the oil, causing the oil to become denser and more optically refractive. Depressurization below the bubble point may lead to redissolution of previously precipitated asphaltenes if the asphaltene redissolution kinetics are relatively fast. In this case, a pressure-temperature line delineates the lower boundary of the APE, below which the asphaltenes redissolve into solution. However, because pressure-induced asphaltene redissolution can be slow, the lower boundary of the APE can be difficult to identify.

The fluid analyzer 208 also includes dual spectrometers—a filter-array spectrometer and a grating-type spectrometer. The filter-array spectrometer of the analyzer 208 includes a broadband light source providing broadband light that passes along optical guides and through an optical chamber in the flowline to an array of optical density detectors that are designed to detect narrow frequency bands (commonly referred to as channels) in the visible and near-infrared spectra as described in U.S. Pat. No. 4,994,671, incorporated herein by reference in its entirety. Preferably, these channels include a subset of channels that detect water absorption peaks (which are used to characterize water content in the fluid) and a dedicated channel corresponding to the absorption peak of $CO_2$ with dual channels above and below this dedicated channel that subtract out the overlapping spectrum of hydrocarbon and small amounts of water (which are used to characterize $CO_2$ content in the fluid). The filter-array spectrometer also employs optical filters that provide for identification of the color (also referred to as "optical density" or "OD") of the fluid in the flowline. Such color measurements support fluid identification, determination of asphaltene content, and pH measurement. Mud filtrates or other solid materials generate noise in the channels of the filter-array spectrometer. Scattering caused by these particles is independent of wavelength. In the preferred embodiment, the effect of such scattering can be removed by subtracting a nearby channel.

The grating-type spectrometer of the fluid analyzer 208 is designed to detect channels in the near-infrared spectra (preferably between 1600 and 1800 nm) where reservoir fluid has absorption characteristics that reflect molecular structure.

The fluid analyzer 208 also includes a pressure sensor for measuring pressure of the formation fluid in the flowline 207, a temperature sensor for measuring temperature of the formation fluid in the flowline 207, and a density sensor for measuring live fluid density of the fluid in the flowline 207. In the preferred embodiment, the density sensor is realized by a vibrating sensor that oscillates in two perpendicular modes within the fluid. Simple physical models describe the resonance frequency and quality factor of the sensor in relation to live fluid density. Dual mode oscillation is advantageous over other resonant techniques because it minimizes the effects of pressure and temperature on the sensor through common mode rejection. In addition to density, the density sensor can also provide a measurement of live fluid viscosity from the quality factor of oscillation frequency. Note that live fluid viscosity can also be measured by placing a vibrating object in the fluid flow and measuring the increase in line width of any fundamental resonance. This increase in line width is related closely to the viscosity of the fluid. The change in frequency of the vibrating object is closely associated with the mass density of the object. If density is measured independently, then the determination of viscosity is more accurate because the effects of a density change on the mechanical resonances are determined. Generally, the response of the vibrating object is calibrated against known standards. The fluid analyzer 208 can also measure resistivity and pH of the fluid in the flowline 207. In the preferred embodiment, the fluid analyzer 208 is realized by the InSitu Fluid Analyzer available from Schlumberger Technology Corporation. In other exemplary implementations, the flowline sensors of the fluid analyzer 208 may be replaced or supplemented with other types of suitable measurement sensors (e.g., NMR sensors and capacitance sensors). Pressure sensor(s) and/or temperature sensor(s) for measuring pressure and temperature of fluid drawn into the flowline 207 can also be part of the probe 202.

A pump 228 is fluidly coupled to the flowline 207 and is controlled to draw formation fluid into the flowline 207 and possibly to supply formation fluid to the fluid collecting chambers 22 and 23 (FIG. 1A) via valve 229 and flowpath 231 (FIG. 1B).

The fluid analysis module 25' includes a data processing system 213 that receives and transmits control and data signals to the other components of the fluid analysis module 25' for controlling operations of the module 25'. The data processing system 213 also interfaces to the fluid analyzer 208 for receiving, storing and processing the measurement data generated therein. In the preferred embodiment, the data processing system 213 processes the measurement data output by the fluid analyzer 208 to derive and store measurements of the hydrocarbon composition of fluid samples analyzed in-situ by the fluid analyzer 208, including

- flowline temperature;
- flowline pressure;
- live fluid density ($\rho$) at the flowline temperature and pressure;
- live fluid viscosity ($\mu$) at the flowline temperature and pressure;
- concentrations (e.g., weight percentages) of carbon dioxide ($CO_2$), methane ($CH_4$), ethane ($C_2H_6$), the C3-C5 alkane group, the lump of hexane and heavier alkane components (C6+), and asphaltene content;
- GOR; and
- possibly other parameters (such as API gravity and oil formation volume factor ($B_O$))

Flowline temperature and pressure are measured by the temperature sensor and pressure sensor, respectively, of the fluid analyzer 208 (and/or probe 202). In the preferred embodiment, the output of the temperature sensor(s) and pressure sensor(s) are monitored continuously before, during, and after sample acquisition to derive the temperature and pressure of the fluid in the flowline 207. The formation temperature is not likely to deviate substantially from the flowline temperature at a given measurement station and thus can be estimated as the flowline temperature at the given measurement station in many applications. Formation pressure can be measured by the pressure sensor of the fluid analyzer 208 in conjunction with the downhole fluid sampling and analysis at a particular measurement station after buildup of the flowline to formation pressure.

Live fluid density (ρ) at the flowline temperature and pressure is determined by the output of the density sensor of the fluid analyzer 208 at the time the flowline temperature and pressure are measured.

Live fluid viscosity (μ) at flowline temperature and pressure is derived from the quality factor of the density sensor measurements at the time the flowline temperature and pressure is measured.

The measurements of the hydrocarbon composition of fluid samples are derived by translation of the data output by spectrometers of the fluid analyzer 208. In the preferred embodiment, such translation employs an empirical relation that relates color (i.e., optical density) measured by the spectrometer of the fluid analyser 208 to a measurement of concentration of a high molecular weight fraction of the reservoir fluids of the form:

$$OD_{DFA}=C1*W_a+C2, \quad (1)$$

where $OD_{DFA}$ is the measured color of the formation fluid at a particular wavelength (this particular wavelength can vary over different reservoirs, but usually it will be in the ultra-violet or visible or near-infrared parts of the spectrum);

$W_a$ is the corresponding volume fraction of the high molecular weight fraction; and C1 and C2 are constants derived from empirical data.

The particular wavelength can be sensitive to the class and/or concentration of the high molecular weight fraction of interest. More specifically, lower wavelengths (e.g., wavelengths in the visible band around 500 nm) are typically better suited to characterize resins, visible wavelengths between 700 nm and 900 nm are typically better suited to characterize asphaltene nanoaggregates, and longer wavelengths (e.g., wavelengths in the near-infrared band around 1000 nm) are typically better suited to characterize asphaltene clusters.

The GOR is determined by measuring the quantity of methane and liquid components of crude oil using near-infrared absorption peaks. The ratio of the methane peak to the oil peak on a single phase live crude oil is directly related to GOR.

The fluid analysis module 25' can also detect and/or measure other fluid properties of a given live oil sample, including retrograde dew formation, asphaltene precipitation, and/or gas evolution.

The fluid analysis module 25' also includes a tool bus 214 that communicates data signals and control signals between the data processing system 213 and the surface-located control system 18 of FIG. 1A. The tool bus 214 can also carry electrical power supply signals generated by a surface-located power source for supply to the fluid analysis module 25', and the module 25' can include a power supply transformer/regulator 215 for transforming the electric power supply signals supplied via the tool bus 214 to appropriate levels suitable for use by the electrical components of the module 25'.

Although the components of FIG. 1B are shown and described above as being communicatively coupled and arranged in a particular configuration, persons of ordinary skill in the art will appreciate that the components of the fluid analysis module 25' can be communicatively coupled and/or arranged differently than depicted in FIG. 1B without departing from the scope of the present disclosure. In addition, the example methods, apparatus, and systems described herein are not limited to a particular conveyance type but, instead, may be implemented in connection with different conveyance types including, for example, coiled tubing, wireline, wired drill pipe, and/or other conveyance means known in the industry.

In accordance with the present invention, the system of FIGS. 1A and 1B can be employed with the methodology of FIGS. 2A-2D to characterize the fluid properties of a petroleum reservoir of interest based upon downhole fluid analysis of samples of reservoir fluid. As will be appreciated by those skilled in the art, the surface-located electrical control system 18 and the fluid analysis module 25 of the borehole tool 10 each include data processing functionality (e.g., one or more microprocessors, associated memory, and other hardware and/or software) that cooperate to implement the invention as described herein. The electrical control system 18 can also be realized by a distributed data processing system wherein data measured by the borehole tool 10 is communicated in real-time over a communication link (typically a satellite link) to a remote location for data analysis as described herein. The data analysis can be carried out on a workstation or other suitable data processing system (such as a computer cluster or computing grid).

The fluid analysis of FIGS. 2A-2D relies on an equation of state model to characterize relative concentrations of a high molecular weight fraction (in the preferred embodiment, an asphaltene pseudocomponent) as a function of depth in the oil column as related to relative solubility, density, and molar volume of such high molecular weight fraction at varying depth. In the preferred embodiment, the equation of state model treats the reservoir fluid as a mixture of two parts: a solute part (the high molecular weight fraction) and the oil mixture (or bulk reservoir fluid that includes the lower molecular weight fractions and the high molecular weight fraction). The properties of the oil mixture can be measured by downhole fluid analysis and/or estimated by an EOS model. It is assumed that the reservoir fluids are connected (i.e., there is a lack of compartmentalization) and in thermodynamic equilibrium. In this approach, the relative concentration (volume fraction) of the solute part as a function of depth is given by:

$$\frac{\phi_a(h_2)}{\phi_a(h_1)} = \exp\left\{\begin{array}{c} \frac{v_a g(\rho_m-\rho_a)(h_2-h_1)}{RT} + \left(\frac{v_a}{v_m}\right)_{h_2} - \left(\frac{v_a}{v_m}\right)_{h1} - \\ \frac{v_a\left[(\delta_a-\delta_m)^2_{h_2} - (\delta_a-\delta_m)^2_{h_1}\right]}{RT} \end{array}\right\} \quad (2)$$

where $\phi_a(h_1)$ is the volume fraction for the solute part at depth $h_1$, $\phi_a(h_2)$ is the volume fraction for the solute part at depth $h_2$, $\upsilon_a$ is the partial molar volume for the solute part, $\upsilon_m$ is the molar volume for the oil mixture (solvent part), $\delta_a$ is the solubility parameter for the solute part, $\delta_m$ is the solubility parameter for the oil mixture (solvent part), $\rho_a$ is the partial density for the solute part, $\rho_m$ is the density for the oil mixture (solvent part), R is the universal gas constant, and T is the absolute temperature of the reservoir fluid.

In Eq. (2), referred to herein as the Flory-Huggins-Zuo equation of state, it is assumed that properties of the solute part (e.g., the high molecular weight fraction) are independent of depth. For properties of the oil mixture that are a function of depth, average values between depths can be used. The first exponential term of Eq. (2) arises from gravitational contributions. The second and third exponential terms arise from the combinatorial entropy change of mixing. The fourth exponential term rises from the enthalpy (solubility) change of mixing. It can be assumed that the reservoir fluid is isothermal. In this case, the temperature T can be set to the average formation temperature as determined from downhole fluid analysis. Alternatively, a temperature gradient with depth (preferably a linear temperature distribution) can be derived from downhole fluid analysis and the temperature T at a particular depth determined from such temperature gradient.

The density $\rho_m$ of the oil mixture at one or more depths can be measured by downhole fluid analysis (or laboratory analysis of the reservoir fluids collected from a given depth at reservoir conditions). It can also be derived from the output of the EOS model as described in U.S. Pat. No. 7,822,554, which is incorporated herein by reference in its entirety.

The molar volume $\nu_m$ for the oil mixture at a given depth can be provided by the solution of the EOS model or other suitable approach.

The solubility parameter $\delta_m$ for the oil mixture at a given depth can be derived from an empirical correlation to the density $\rho_m$ of the oil mixture at the given depth. For example, the solubility parameter $\delta_m$ (in $MPa^{0.5}$) can be derived from:

$$\delta_m=17.347\rho_m+2.904 \tag{3}$$

where $\rho_m$ is the density of the oil mixture at the given depth in g/cc.

A linear function of the form of Eq. (4) can be used to correlate a property of the oil mixture (such as molar volume $\nu_m$ and the solubility parameter $\delta_m$) as a function of depth by:

$$\alpha=c\Delta h+\alpha_{ref} \tag{4}$$

where $\alpha$ is the property (such as molar volume $\nu_m$ and the solubility parameter $\delta_m$) of the oil mixture, c is a coefficient, $\alpha_{ref}$ is the property of the oil mixture at a reference depth, and $\Delta h$ is the difference in height relative to the reference depth.

The solubility parameter $\delta_a$ (in $MPa^{0.5}$) of the solute part at a given depth can be derived from the temperature gradient relative to a reference measurement station by:

$$\delta_a(T)=\delta_a(T_0)[1-1.07\times10^{-3}(\Delta T)] \tag{5}$$

where $T_0$ is the temperature at a reference measurement station (e.g., $T_0$=298.15 K), T is the temperature at the given depth, $\Delta T=T-T_0$, and $\delta_a(T_0)$ is a solubility parameter (in $MPa^{0.5}$) for the solute part at $T_0$ (e.g., $\delta_a(T_0)$=21.85 $MPa^{0.5}$).

The impact of pressure on the solubility parameter for the solute part is small and negligible. The temperature gradient in the wellbore can be measured by an optical fiber distributed temperature sensor. Alternatively, the temperature in the wellbore can be measured by downhole fluid analysis at multiple stations. A linear function of the form of Eq. (4) can be used to derive the temperature gradient between stations as a function of depth.

Both temperature and pressure can be accounted for in determining the solubility parameter $\delta_a(P,T)$ for the solute part as:

$$\delta_a(P, T) = \delta_a(P_0, T)\left(\frac{\nu}{\nu_0}\right)_T^{-1.25} \tag{6}$$

where P, $\nu$, and $P_0$ are the pressure, molar volume and the reference pressure, respectively, which can be measured or estimated from the output of the EOS.

The partial density (in $kg/m^3$) of the solute part can be derived from a constant that can vary for the different solute part classes, such as 1.05 g/cc for resins, 1.15 g/cc for asphaltene nanoaggregates, and 1.2 g/cc for asphaltene clusters.

Once the properties noted above are obtained, the remaining adjustable parameter in Eq. (2) is the molar volume of the solute part. The molar volume of the solute part varies for different classes of the high molecular weight fraction. For example, resins have a smaller molar volume than asphaltene nanoaggregates, which have a smaller molar volume than asphaltene clusters. The model assumes that the molar volume of the solute part is constant as a function of depth. A spherical model is preferably used to estimate the molar volume of the solute part by:

$$V=\tfrac{1}{6}*\pi*d^3*Na \tag{7}$$

where V is the molar volume, d is the molecular diameter, and Na is Avogadro's constant.

For example, for the class where the solute part includes resins (with little or no asphaltene nanoaggregates and asphaltene clusters), the molecular diameter d can vary over a range of 1.25±0.15 nm. For the class where the solute part includes asphaltene nanoaggregates (with little or no resins and asphaltene clusters), the molecular diameter d can vary over a range of 1.8±0.2 nm. For the class where the solute part includes asphaltene clusters (with little or no resins and asphaltene nanoaggregates), the molecular diameter d can vary over a range of 4.0±0.5 nm. For the class where the solute part is a mixture of resins and asphaltene nanoaggregates (with little or no asphaltene clusters), the molecular diameter d can vary over the range corresponding to such resins and nanoaggregates (e.g., between 1.25 nm and 1.8 nm). These diameters are exemplary in nature and can be adjusted as desired.

In this manner, Eq. (1) can be used to determine a family of curves for one or more solute part classes. For example, the solute part classes can include resins, asphaltene nanoaggregates, asphaltene clusters, and combinations thereof. One solute part class can include resins with little or no asphaltene nanoaggregates or cluster. Another solute part class can include resins and asphaltene nanoaggregates with little or no clusters. A further solute part class can include asphaltene clusters with little or no resins and asphaltene nanoaggregates. The family of curves represents an estimation of the concentration of the solute part class as a function of depth. Each curve of the respective family is derived from a molecular diameter d that falls within the range of diameters for the corresponding solute part class. A solution can be solved by fitting the curves to corresponding measurements of the concentration of the respective solute part class at varying depths as derived from downhole fluid analysis to determine the best matching curve. For example, the family of curves for the solute part class including resins (with little or no asphaltene nanoaggregates and clusters) can be fit to measurements of resin concentrations (derived from color measurements by downhole fluid analysis as described above) at varying depth. In another example, the family of curves for the solute part class including asphaltene nanoaggregates (with little or no resins and asphaltene clusters) can be fit to measurements of asphaltene nanoaggregate concentrations (derived from color measurements by downhole fluid analysis as described above) at varying depth. In yet another example, the family of curves for the solute part class including resins and asphaltene nanoaggregates (with little or no asphaltene clusters) can be fit to measurements of mixed resins and asphaltene nanoaggregate concentrations (derived from color measurements by downhole fluid analysis as described above) at varying depth. In still another example, the family of curves for the solute part class including asphaltene clusters (with little or no resins and asphaltene nanoaggregates) can be fit to measurements of asphaltene cluster concentrations (derived from color measurements by downhole fluid analysis as described above) at varying depth. If a best fit is identified, the estimated and/or measured properties of the best matching solute class (or other suitable properties) can be used for reservoir analysis. If no fit is possible, then the reservoir fluids might not be in equilibrium or a more complex formulism may be required to describe the petroleum fluid in the reservoir.

Other suitable structural models can be used to estimate and vary the molar volume for the different solute part classes. It is also possible that Eq. (2) can be simplified by ignoring all but the first term, which gives an analytical model of the form:

$$\frac{\phi_a(h_2)}{\phi_a(h_1)} = \exp\left\{\frac{v_a g(\rho_m - \rho_a)(h_2 - h_1)}{RT}\right\}. \tag{8}$$

This Eq. (8) can be solved in a manner similar to that described above for Eq. (2) in order to derive the relative concentration of solute part as a function of depth (h) in the reservoir.

The operations of FIGS. 2A-2D begin in step 201 by employing the DFA tool of FIGS. 1A and 1B to obtain a sample of the formation fluid at the reservoir pressure and temperature (a live oil sample) at a measurement station in the wellbore (for example, a reference station). The sample is processed by the fluid analysis module 25. In the preferred embodiment, the fluid analysis module 25 performs spectrophotometry measurements that measure absorption spectra of the sample and translates such spectrophotometry measurements into concentrations of several alkane components and groups in the fluids of interest. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, pentane, the lump of hexane and heavier alkane components (C6+), and asphaltene content. The borehole tool 10 also preferably provides a means to measure temperature of the fluid sample (and thus reservoir temperature at the station), pressure of the fluid sample (and thus reservoir pressure at the station), live fluid density (ρ) of the fluid sample, live fluid viscosity (μ) of the fluid sample, gas-oil ratio (GOR) of the fluid sample, optical density, and possibly other fluid parameters (such as API gravity and formation volume factor ($B_O$)) of the fluid sample.

In step 203, a delumping process is carried out to characterize the compositional components of the sample analyzed in step 201. The delumping process splits the concentration (e.g., mass fraction, which is sometimes referred to as weight fraction) of given compositional lumps (C3-C5, C6+) into concentrations (e.g., mass fractions) for single carbon number (SCN) components of the given compositional lump (e.g., split C3-C5 lump into C3, C4, C5, and split C6+ lump into C6, C7, C8 . . . ). Details of the exemplary delumping operations carried out as part of step 203 are described in U.S. Pat. No. 7,920,970, incorporated herein by reference in its entirety.

In step 205, the results of the delumping process of step 203 are used in conjunction with an equation of state (EOS) model to predict compositions and fluid properties (such as volumetric behavior of oil and gas mixtures) as a function of depth in the reservoir. In the preferred embodiment, the predictions of step 205 include property gradients, pressure gradients, and temperature gradients of the reservoir fluid as a function of depth. The property gradients preferably include density, viscosity, molecular weights, and specific gravities for a set of SCN components (but not for asphaltenes) as a function of depth in the reservoir. The property gradients predicted in step 205 preferably do not include compositional gradients (i.e., mass fractions and mole fractions) for the heavy molecular weight fraction (e.g., resin and asphaltenes) as a function of depth, as such analysis is provided by an equation of state model as described herein in more detail.

The EOS model of step 205 includes a set of equations that represent the phase behavior of the compositional components of the reservoir fluid. Such equations can take many forms. For example, they can be any one of many cubic EOS, as is well known. Such cubic EOS include van der Waals EOS (1873), Redlich-Kwong EOS (1949), Soave-Redlich-Kwong EOS (1972), Peng-Robinson EOS (1976), Stryjek-Vera-Peng-Robinson EOS (1986) and Patel-Teja EOS (1982). Volume shift parameters can be employed as part of the cubic EOS in order to improve liquid density predictions, as is well known. Mixing rules (such as van der Waals mixing rule) can also be employed as part of the cubic EOS. A SAFT-type EOS can also be used, as is well known in the art. In these equations, the deviation from the ideal gas law is largely accounted for by introducing (1) a finite (non-zero) molecular volume and (2) some molecular interaction. These parameters are then related to the critical constants of the different chemical components.

In the preferred embodiment, the EOS model of step 205 predicts compositional gradients with depth that take into account the impacts of gravitational forces, chemical forces, thermal diffusion, etc. To calculate compositional gradients with depth in a hydrocarbon reservoir, it is usually assumed that the reservoir fluids are connected (i.e., there is a lack of compartmentalization) and in thermodynamic equilibrium (with no adsorption phenomena or any kind of chemical reactions in the reservoir). The mass flux (J) of compositional component i that crosses the boundary of an elementary volume of the porous media is expressed as:

$$J_i = \rho_i\left(\sum_{j=1}^{n}(L_{ij}\nabla_T g_j^t) + L_{ip}(\rho g - \nabla P) + L_{iq}\nabla T\right) \tag{9}$$

where $L_{ij}$, $L_{ip}$, and $L_{iq}$ are the phenomenological coefficients, $\rho_i$ denotes the partial density of component i, ρ, g, P, T are the density, the gravitational acceleration, pressure, and temperature, respectively, and $g_j^t$ is the contribution of component j to mass free energy of the fluid in a porous media, which can be divided into a chemical potential part $\mu_i$ and a gravitational part gz (where z is the vertical depth).

The average fluid velocity (u) is estimated by:

$$u = \frac{\sum_{j=1}^{n} J_j}{\rho}. \tag{10}$$

According to Darcy's law, the phenomenological baro-diffusion coefficients must meet the following constraint:

$$\frac{k}{\eta} = \frac{\sum_{j=1}^{n} \rho_j L_{jp}}{\rho} \tag{11}$$

where k and η are the permeability and the viscosity, respectively.

If the pore size is far above the mean free path of molecules, the mobility of the components, due to an external pressure field, is very close to the overall mobility. The mass chemical potential is a function of mole fraction (x), pressure, and temperature.

At constant temperature, the derivative of the mass chemical potential ($\mu_j$) has two contributions:

$$\nabla_T \mu_j = \sum_{k=1}^{n} \left(\frac{\partial \mu_j}{\partial x_k}\right)_{T,P,x_{i\neq k}} \nabla x_k + \left(\frac{\partial \mu_j}{\partial P}\right)_{T,x} \nabla P \tag{12}$$

where the partial derivatives can be expressed in terms of EOS (fugacity coefficients):

$$\left(\frac{\partial \mu_j}{\partial x_k}\right)_{T,P,x_{j\neq k}} = \frac{RT}{M_j}\left(\frac{\partial \ln f_j}{\partial x_k}\right)_{T,P,x_{j\neq k}} = \frac{RT}{M_j}\left(\frac{\delta_{jk}}{x_k} + \frac{1}{\varphi_j}\left(\frac{\partial \varphi_j}{\partial x_k}\right)_{T,P,x_{j\neq k}}\right) \tag{13}$$

$$\left(\frac{\partial \mu_j}{\partial P}\right)_{T,x} = \frac{\bar{v}_j}{M_j} = \frac{RT}{M_j}\left(\frac{1}{P} + \left(\frac{\partial \varphi_j}{\partial P}\right)_{T,x}\right) \tag{14}$$

where $M_j$, $f_j$, $\phi_j$, and $v_j$ are the molecular mass, fugacity, fugacity coefficient, and partial molar volume of component j, respectively;

$x_k$ is the mole fraction of component k;

R denotes the universal gas constant; and

δ is the Kronecker delta function.

In the ideal case, the phenomenological coefficients (L) can be related to effective practical diffusion coefficients ($D_i^{eff}$):

$$L_{ii} = -\frac{M_i}{RT} D_i^{eff}. \tag{15}$$

The mass conservation for component i in an n-component reservoir fluid, which governs the distribution of the components in the porous media, is expressed as:

$$\frac{\partial \rho_i}{\partial t} + \nabla J_i = 0, \quad i = 1, 2, \ldots, n. \tag{16}$$

This Eq. (16) can be used to solve a wide range of problems. This is a dynamic model which is changing with time t.

Consider that the mechanical equilibrium of the fluid column has been achieved:

$$\nabla_z P = \rho g. \tag{17}$$

The vertical distribution of the components can be calculated by solving the following set of equations:

$$\frac{\partial \ln f_i}{\partial z} - \frac{M_i g}{RT} + \frac{J_{i,z}}{x_i D_i^{eff}} \frac{M}{\rho M_i} - \frac{L_{iq}}{D_i^{eff}} \frac{\partial T}{\partial z} = 0, \quad i = 1, 2, \ldots, n \tag{18}$$

and $$\sum_{k=1}^{n} \left(\frac{\delta_{ik}}{x_k} + \frac{1}{\varphi_i}\frac{\partial \varphi_i}{\partial x_k}\right) \nabla_z x_k + \frac{(v_i \rho - M_i) g}{RT} + \frac{J_{i,z}}{x_i D_i^{eff}} \frac{M}{\rho M_i} - \frac{L_{iq}}{D_i^{eff}} \frac{\partial T}{\partial z} = 0 \tag{19}$$

where $J_{i,z}$ is the vertical component of the external mass flux and M is the average molecular mass. This formulation allows computation of the stationary state of the fluid column and does not require modeling of the dynamic process leading to the observed compositional distribution.

If the horizontal components of external fluxes are significant, the equations along the other axis have to be solved as well. Along a horizontal "x" axis the equations become:

$$\frac{\partial \ln f_i}{\partial x} + \frac{J_{i,x}}{x_i D_i^{eff}} \frac{M}{\rho M_i} - \frac{L_{iq}}{D_i^{eff}} \frac{\partial T}{\partial x} = 0. \tag{20}$$

The mechanical equilibrium of the fluid column $\nabla_z P = \rho g$, is a particular situation which will occur only in highly permeable reservoirs. In the general case, the vertical pressure gradient is calculated by:

$$\nabla_z P = \rho g - \frac{\nabla_z P_{Fluxes} + \nabla_z P_{Soret}}{1 + R_p} \tag{21}$$

where $R_p$ is calculated by $$R_p = RT \frac{k}{\eta} \frac{\rho}{M} \sum_{i=1}^{n} \frac{x_i}{D_i^{eff}}. \tag{22}$$

The pressure gradient contribution from thermal diffusion (so-called Soret contribution) is given by:

$$\nabla_z P_{Soret} = RT \frac{\rho}{M} \sum_{i=1}^{n} x_i \frac{L_{iq}}{D_i^{eff}} \nabla_z T. \tag{23}$$

And the pressure gradient contribution from external fluxes is expressed as:

$$\nabla_z P_{Fluxes} = RT \sum_{i=1}^{n} \frac{J_{i,z}}{M_i D_i^{eff}}. \tag{24}$$

Assuming an isothermal reservoir and ignoring the external flux, results in the following equation:

$$\frac{\partial \ln f_i}{\partial z} - \frac{M_i g}{RT} = 0,\ i = 1, 2, \ldots, n. \tag{25}$$

The Eq. (25) can be rewritten as:

$$\frac{\partial \ln f_i}{\partial z} - \frac{M_i g}{RT} + a_i = 0,\ i = 1, 2, \ldots, n. \tag{26}$$

where $a_i$ is computed by:

$$a_i = \frac{J_{i,z}}{x_i D_i^{eff}} \frac{M}{\rho M_i} - \frac{L_{iq}}{D_i^{eff}} \frac{\partial T}{\partial z},\ i = 1, 2, \ldots, n. \tag{27}$$

The first part of the $a_i$ term of Eq. (27) can be simplified to:

$$\frac{J_{i,z}}{x_i \rho D_i^{eff}}. \tag{28}$$

The second part of the $a_i$ term of Eq. (27) can be written in the form proposed by Haase in "Thermodynamics of Irreversible Processes," Addison-Wesley, Chapter 4, 1969. In this manner, $a_i$ is computed by:

$$a_i = \frac{J_{i,z}}{x_i \rho D_i^{eff}} + M_i\left(\frac{H_m}{M_m} - \frac{H_i}{M_i}\right)\frac{\Delta T}{T},\ i = 1, 2, \ldots, n \tag{29}$$

where $H_i$ is the partial molar enthalpy for component i, $H_m$ is the molar enthalpy for the mixture, $M_i$ is the molecular mass for component i, $M_m$ is the molecular mass for the mixture, T is the formation temperature, and ΔT is the temperature between two vertical depths.

The first part of the $a_i$ term of Eqs. (27), (28) and (29) accounts for external fluxes in the reservoir fluid. It can be ignored if a steady state is assumed. The second part of the $a_i$ term of Eqs. (27) and (29) accounts for a temperature gradient in the reservoir fluid. It can be ignored if an isothermal reservoir is assumed.

The fugacity $f_i$ of component i at a given depth can be expressed as a function of the fugacity coefficient and mole fraction for the component i and reservoir pressure (P) at the given depth as:

$$f_i = \phi_i x_i P. \tag{30}$$

The mole fractions of the components at a given depth must further sum to 1 such that $$\sum_{i=1}^{N} x_i = 1$$

at a given depth. Provided the mole fractions and the reservoir pressure and temperature are known at the reference station, these equations can be solved for mole fractions (and mass fractions), partial molar volumes and volume fractions for the reservoir fluid components and pressure and temperature as a function of depth. Flash calculations can solve for fugacities of components that form at equilibrium. Details of suitable flash calculations are described by Li in "Rapid Flash Calculations for Compositional Simulation," *SPE Reservoir Evaluation and Engineering*, October 2006, incorporated herein by reference in its entirety. The flash equations are based on a fluid phase equilibria model that finds the number of phases and the distribution of species among the phases, that minimizes Gibbs Free Energy. More specifically, the flash calculations calculate the equilibrium phase conditions of a mixture as a function of pressure, temperature, and composition. The fugacities of the components derived from such flash calculations can be used to solve for the compositional gradient (component concentrations) of the reservoir fluid as a function of depth.

In step 205, the EOS model may account for drilling fluid contamination. Examples of suitable EOS model extensions that correct for drilling fluid contamination are described in International Patent Application Publication WO 2009/138911, incorporated herein by reference in its entirety.

In step 205, the predictions of compositional gradient can be used to predict properties of the reservoir fluid as a function of depth (typically referred to as a property gradient), as is well known. For example, the predictions of compositional gradient can be used to predict bubble point pressure, dew point pressure, live fluid molar volume, molecular weight, gas-oil ratio, live fluid density (ρ), live fluid viscosity (μ), stock tank oil density, and other pressure-volume-temperature (PVT) properties as a function of depth in the reservoir, as is well known in the art.

In step 207, the borehole tool 10 of FIGS. 1A and 1B is used to obtain a sample of the formation fluid at the reservoir pressure and temperature (a live oil sample) at another measurement station in the wellbore, and the downhole fluid analysis as described above with respect to step 201 is performed on this sample. In an illustrative embodiment, the fluid analysis module 25 provides measurements of the concentrations (e.g., weight percentages) of carbon dioxide ($CO_2$), methane ($CH_4$), ethane ($C_2H_6$), the C3-C5 alkane group including propane, butane, pentane, the lump of hexane and heavier alkane components (C6+), and asphaltene content. The borehole tool 10 also preferably provides a means to measure temperature of the fluid sample (and thus reservoir temperature at the station), pressure of the fluid sample (and thus reservoir pressure at the station), live fluid density of the fluid sample, live fluid viscosity of the fluid sample, gas-oil ratio (GOR) of the fluid sample, optical density, and possibly other fluid parameters (such as API gravity and formation volume factor ($B_O$)) of the fluid sample. For example, concentrations of the gas-phase components and the liquid phase components output by the EOS model as a function of depth in the reservoir can be used to predict GOR as a function of depth in the reservoir, as is well known.

Optionally, in step 209 the EOS model of step 205 can be tuned based on a comparison of the compositional and fluid property predictions derived by the EOS model of step 205 and the compositional and fluid property analysis of the borehole tool 10 in 207. Laboratory data can also be used to tune the EOS model. Such tuning typically involves selecting parameters of the EOS model in order to improve the accuracy of the predictions generated by the EOS model. EOS model parameters that can be tuned include critical pressure, critical temperature, and acentric factor for single carbon components, binary interaction coefficients, and volume translation parameters. An example of EOS model tuning is described in Reyadh A. Almehaideb et al., "EOS tuning to model full field crude oil properties using multiple well fluid PVT analysis," *Journal of Petroleum Science and Engineering*, Volume 26, Issues 1-4, pgs. 291-300, 2000, incorporated herein by reference in its entirety. In the event that the EOS model is tuned, the compositional and fluid property predictions of step 205 can be recalculated from the tuned EOS model.

In step 211, the properties of the oil mixture measured by downhole fluid analysis in steps 201 and 209 (and/or via laboratory analysis) as well as the results of the EOS model generated in step 205 (or in step 209 in the event the EOS model is tuned) can be used to derive EOS model inputs. For example, the density $\rho_m$ of the oil mixture can be measured by downhole fluid analysis (or laboratory analysis of the reservoir fluids collected from a given depth at reservoir conditions). The molar volume $\nu_m$ for the oil mixture at a given depth can be provided by the solution of EOS model or other suitable approach. The solubility parameter $\delta_m$ for the oil mixture at a given depth can be derived from an empirical correlation to the density $\rho_m$ of the oil mixture at the given depth as set forth in Eq. (3). A linear function of the form of Eq. (4) can be used to correlate a property of the oil mixture (such as density $\rho_m$, molar volume $\nu_m$, and the solubility parameter $\delta_m$) as a function of depth.

In step 213, a Flory-Huggins-Zuo type equation of state model as described above with respect to Eq. (2) is used to generate a family of curves that predict the concentration of one or more solute part classes as a function of depth in the reservoir. The curves are based upon the inputs generated in step 211.

For each respective solute part class, the family of curves derived in step 213 is compared to measurements of concentration for the respective solute part class (derived from color measurements by downhole fluid analysis as described above) at corresponding depths in step 215. The comparisons are evaluated to identify the solute part class that best satisfies a predetermined matching criterion. Details of exemplary operations that employ a Flory-Huggins-Zuo type equation of state model to generate a family of curves that predict the concentration of one or more solute part classes as a function of depth in the reservoir, that derive measurements of concentration for the respective solute part class from color measurements by downhole fluid analysis, and that identify the solute part class (if any) that best satisfies a predetermined matching criterion between the predicted solute part concentrations and measured solute part concentrations at corresponding depths are described in International Patent Application Publication WO 2011/007268 and International Patent Application PCT/IB2011/051230, incorporated herein by reference in their entireties. One or more solute part classes that satisfy the predetermined matching criterion are then evaluated to determine the best matching solute part class. The evaluation provides an indication that the reservoir fluids are in thermodynamic equilibrium within a non-compartmentalized reservoir and an indication of the particular solute part class (and thus the assumption of composition underlying the particular solute part class) that is the best match to the measured gradient for the solvent part high molecular weight fraction. In the event that there is only one particular matching solute part class, step 215 can provide an indication that the reservoir fluids are in thermodynamic equilibrium within a non-compartmentalized reservoir and an indication of the one particular matching solute part class that matches the measured gradient for the solvent part high molecular weight fraction.

The best matching curve provides a concentration profile of asphaltene pseudocomponents (e.g., resins, asphaltene nanoaggregates, larger asphaltene clusters, and combinations thereof) and corresponding aggregate size of asphaltenes as a function of depth in the reservoir. The asphaltene concentration profile dictated by the best matching curve can be used to predict gradients for fluid properties (such as fluid density and fluid viscosity) that relate to asphaltene content. For predicting viscosity, the predictions can be based on the empirical correlation of the form proposed by Lohrenz, Bray and Clark in "Calculating Viscosity of Reservoir Fluids from their Composition," *Journal of Petroleum Technology*, October 1964, pp. 1171-1176, or the empirical correlation of the form proposed by Pedersen et al. in "Viscosity of Crude Oils," *Chemical Engineering Science*, Vol. 39, No. 6, pp. 1011-1016, 1984.

In steps 217-235, operations are performed that are specific to the particular best-matching solute part class identified in step 215. In an illustrative embodiment, the solute part classes can include the following:

i) a solute part class including resins (with little or no asphaltene nanoaggregates and clusters);

ii) a solute part class including asphaltene nanoaggregates (with little or no resins and asphaltene clusters);

iii) a solute part class including resins and asphaltene nanoaggregates (with little or no asphaltene clusters);

iv) a solute part class including asphaltene clusters (with little or no resins and asphaltene nanoaggregates); and v) a solute part class including a mixture of asphaltene nanoaggregates and clusters (with little or no resins).

In this illustrative embodiment, the result of the evaluation of step 215 is analyzed to determine if the best matching solute part class includes resins (with little or no asphaltene nanoaggregates or clusters). If this condition is true, the operations continue to step 219. Otherwise the operations continue to step 221.

In step 219, the workflow infers a likelihood that the reservoir fluids are in a state of thermodynamic equilibrium within a non-compartmentalized (connected) reservoir, and the reservoir fluids include resins (with little or no asphaltene nanoaggregates or asphaltene clusters) in accordance with assumptions underlying the best matching solute part. In this case, the reservoir fluid includes condensates with a very small concentration of asphaltenes. Essentially, the high content of dissolved gas and light hydrocarbons create a very poor solvent for asphaltenes. Moreover, processes that generate condensates do not tend to generate asphaltenes. Consequently, there is very little crude oil color as determined by DFA in the near-infrared. Nevertheless, there are asphaltene-like molecules—the resins—that absorb visible light and at times even some near-infrared light. These resin molecules are largely dispersed in the condensate as molecules—thereby reducing the impact of the gravitational term. In addition, condensates exhibit considerable gradients. Since condensates are compressible, the hydrostatic head pressure of the condensate column generates a density gradient in the column. The density gradient creates the driving force to create a chemical composition gradient. The result is that Eq. (2) can be simplified by ignoring all but the last term, which gives an analytical model of the form:

$$\frac{\phi_a(h_2)}{\phi_a(h_1)} = \exp\left\{-\frac{v_a\left[(\delta_a-\delta_m)^2_{h_2}-(\delta_a-\delta_m)^2_{h_1}\right]}{RT}\right\}. \quad (31)$$

The lower density components tend to rise in the column while the higher density components tend to settle down in the column, which leads to a GOR gradient. This GOR gradient gives rise to a large solubility contrast for the resins, thereby producing significant DFA color gradients. Fluid density and viscosity gradients can be derived from DFA measurements. These gradients are useful to check for reservoir connectivity, as described in U.S. patent application Ser. No. 12/752,967, which is incorporated herein by reference in its entirety. Accordingly, the GOR gradient as determined by DFA measurements can be evaluated for reservoir analysis. The predicted and/or measured concentration of the resin component as a function of depth can also be evaluated for reservoir analysis. More specifically, non-compartmentalization (connectivity) can be indicated by moderately decreasing GOR values with depth, a continuous increase of resin content as a function of depth, and/or a continuous increase of fluid density and/or fluid viscosity as a function of depth. On the other hand, compartmentalization and/or non-equilibrium conditions can be indicated by discontinuous GOR (or if lower GOR is found higher in the column), discontinuous resin content (or if higher asphaltene content is found higher in the column), and/or discontinuous fluid density and/or fluid viscosity (or if higher fluid density and/or fluid viscosity is found higher in the column).

In step 221, the result of the evaluation of step 215 is analyzed to determine if the best matching solute part class includes asphaltene nanoaggregates (with little or no resins and asphaltene clusters). If this condition is true, the operations continue to step 223. Otherwise the operations continue to step 225.

In step 223, the workflow infers a likelihood that the reservoir fluids are in a state of thermodynamic equilibrium within a non-compartmentalized (connected) reservoir, and the reservoir fluids include asphaltene nanoaggregates (with little or no resins and asphaltene clusters) in accordance with assumptions underlying the best matching solute part class. In this case, the predicted and/or measured concentration of the asphaltene nanoaggregates as a function of depth can be evaluated for reservoir analysis. Fluid density and viscosity gradients can be derived from DFA measurements, as described in U.S. patent application Ser. No. 12/752,967. These gradients are useful to check for reservoir connectivity. More specifically, non-compartmentalization (connectivity) can be indicated by a continuous increase of asphaltene nanoaggregate content as a function of depth, and/or a continuous increase of fluid density and/or fluid viscosity as a function of depth. On the other hand, compartmentalization and/or non-equilibrium conditions can be indicated by discontinuous asphaltene nanoaggregate content (or if higher asphaltene nanoaggregate content is found higher in the column), and/or discontinuous fluid density and/or fluid viscosity (or if higher fluid density and/or fluid viscosity is found higher in the column).

In step 225, the result of the evaluation of step 215 is analyzed to determine if the best matching solute part class includes a mixture of resins and asphaltene nanoaggregates (with little or no asphaltene clusters). If this condition is true, the operations continue to step 227. Otherwise, the operations continue to step 229.

In step 227, the workflow infers a likelihood that the reservoir fluids are in a state of thermodynamic equilibrium within a non-compartmentalized (connected) reservoir, and the reservoir fluids include a mixture of resins and asphaltene nanoaggregates (with little or no asphaltene clusters) in accordance with assumptions underlying the best matching solute part class. In this case, the predicted and/or measured concentration of the mixture of resins and asphaltene nanoaggregates as a function of depth can be evaluated for reservoir analysis. Fluid density and viscosity gradients can be derived from DFA measurements, as described in U.S. patent application Ser. No. 12/752,967. These gradients are useful to check for reservoir connectivity. More specifically, non-compartmentalization (connectivity) can be indicated by a continuous increase of the concentration of the resin/asphaltene nanoaggregate mixture as a function of depth, and/or a continuous increase of fluid density and/or fluid viscosity as a function of depth. On the other hand, compartmentalization and/or non-equilibrium conditions can be indicated by discontinuous concentration of the resin/asphaltene nanoaggregate mixture (or if a higher concentration of the resin/asphaltene nanoaggregate mixture is found higher in the column), and/or discontinuous fluid density and/or fluid viscosity (or if higher fluid density and/or fluid viscosity is found higher in the column).

In step 229, the result of the evaluation of step 215 is analyzed to determine if the best matching solute part class includes asphaltene clusters (with little or no resins and asphaltene nanoaggregates). If this condition is true, the operations continue to step 231. Otherwise, the operations continue to step 230.

In step 231, the workflow infers a likelihood that the reservoir fluids are in a state of thermodynamic equilibrium within a non-compartmentalized (connected) reservoir, and the reservoir fluids include asphaltene clusters (with little or no resins and asphaltene nanoaggregates) in accordance with assumptions underlying the best matching solute part class. Because asphaltene clusters are expected in the oil column, it is anticipated that:

- large density and viscosity gradients exist in the oil column;
- the oil may have flow assurance problems (due to instability from e.g., the asphaltene onset pressure being equal to or greater than the formation pressure of phase-separated bitumen in the formation); and
- there may be a tar mat in the reservoir. The operations then continue to step 232.

In step 230, the result of the evaluation of step 215 is analyzed to determine if the best matching solute part class includes a mixture of asphaltene nanoaggregates and clusters (with little or no resins). If this condition is true, the operations continue to step 234. Otherwise, the operations continue to step 233.

In step 234, the workflow infers a likelihood that the reservoir fluids are in a state of thermodynamic equilibrium within a non-compartmentalized (connected) reservoir, and the reservoir fluids include a mixture of asphaltene nanoaggregates and clusters (with little or no resins) in accordance with assumptions underlying the best matching solute part class. The operations then proceed to step 232.

In step 232, the workflow investigates the likelihood of asphaltene instability in the reservoir fluids. The operations of step 232 can also identify the location of asphaltene deposition in the reservoir. Details of exemplary operations carried out as part of step 232 are described below with respect to FIGS. 3A-3E.

In step 233, the evaluation of step 215 has determined that no suitable match has been found between the solubility curves and the measured properties. In this case, the operations can determine if there is a need for additional measurement stations and/or different methodologies for repeat processing and analysis in order to improve the confidence level of the measured and/or predicted fluid properties. For example, the measured and/or predicted properties of the reservoir fluid can be compared to a database of historical reservoir data to determine the measured and/or predicted properties make sense. If the data are not consistent, additional measurement station(s) or different methodologies (e.g., different model(s)) can be identified for repeat processing and analysis in order to improve the confidence level of the measured and/or predicted fluid properties.

If in step 233 there is a need for additional measurement stations and/or different methodologies, the operations can continue to step 235 to repeat the appropriate processing and analysis in order to improve the confidence level of the measured and/or predicted fluid properties.

If in step 233, there is no need for additional measurement stations and/or different methodologies (in other words, there is sufficient confidence level in the measured and/or predicted fluid properties), the operations continue to steps 237 and 239 to investigate whether the reservoir is compartmentalized or non-compartmentalized but in a state of thermodynamic non-equilibrium. Such a determination is supported by the invalidity of the assumptions of reservoir connectivity and thermodynamic equilibrium that underlie the models utilized for predicting the solute part property gradient within the wellbore. The operations of steps 237 and 239 are carried out to distinguish between these two architectures (compartmentalized (step 237) versus non-compartmentalized, but in a state of thermodynamic non-equilibrium (step 239)).

In step 237, the workflow investigates the likelihood that the reservoir is compartmentalized. In step 239, the workflow investigates the likelihood that the reservoir fluids are in a state of thermodynamic non-equilibrium in a non-compartmentalized (connected) reservoir. Specific examples of operations for carrying out the respective investigations of steps 237 and 239 are described in detail in International Patent Application PCT/IB2011/051230, incorporated herein by reference in its entirety.

Subsequent to the investigation of reservoir architecture in steps 219, 223, 227, 231, 234, 237, and 239, the results of such investigations are reported to interested parties in step 241. The characteristics of the reservoir architecture reported in step 241 can be used to model and/or understand the reservoir of interest for reservoir assessment, planning, and management.

FIGS. 3A-3E illustrate operations for investigating the likelihood of asphaltene instability in the reservoir fluids and the location of asphaltene instability and asphaltene deposition in the reservoir, if any. Asphaltene instability occurs when asphaltene clusters fall out of suspension in the reservoir fluids and start flocculation in the reservoir fluids. In other words, asphaltene instability occurs when the asphaltene clusters form floccules that are no longer in a stable colloid and precipitate out of the reservoir fluids. The onset of such asphaltene instability is referred to herein as asphaltene flocculation onset or asphaltene flocculation onset conditions.

The operations begin in step 301 where the workflow derives the solubility parameter $\delta_m$ of the oil mixture as a function of reservoir pressure. The solubility parameter $\delta_m$ for the oil mixture at a given depth can be derived from an empirical correlation to the density $\rho_m$ of the oil mixture at the given depth (for example, using the form of Eq. (3) above). The density $\rho_m$ of the oil mixture at one or more depths can be measured by downhole fluid analysis (or laboratory analysis of the reservoir fluids collected from a given depth at reservoir conditions). It can also be derived from the output of the EOS model (step 205 or 209). The reservoir pressure for such depths can be derived from pressure measurements at multiple measurement stations by downhole fluid analysis together with interpolation using the linear relation of Eq. (4) above. Alternatively, the reservoir pressure for such depths can be derived from the output of the EOS modeling (step 211). The relation of the solubility parameter $\delta_m$ of the oil mixture to reservoir pressure can be derived by fitting a line to the solubility parameter $\delta_m$ and reservoir pressure value pairs at corresponding depths.

In step 303, the workflow derives the solubility parameter $\delta_{m,\ onset}$ of the oil at asphaltene flocculation onset conditions as a function of reservoir pressure. It is assumed that the reservoir is isometric at a given temperature T. The solubility parameter $\delta_{m,\ onset}$ at a given depth can be derived from the chemical potential at the given depth, which can be expressed as:

$$\Delta\mu_a = RT\left[\ln\phi_a + 1 - \left(\frac{v_a}{v_m}\right)\right] + v_a(\delta_a - \delta_m)^2 \tag{32}$$

where $\phi_a$ is the volume fraction of the asphaltene solute part (including clusters) at the given depth, $\upsilon_a$ is the partial molar volume for the asphaltene solute part at the given depth, $\upsilon_m$ is the molar volume for the oil mixture at the given depth, $\delta_a$ is the solubility parameter for the asphaltene solute part at the given depth, $\delta_m$ is the solubility parameter for the oil mixture at the given depth, R is the universal gas constant, and T is the absolute temperature of the reservoir fluid.

At the asphaltene flocculation onset, the chemical potential can be set to zero assuming that the asphaltene solute part are pure components in the precipitated asphaltene phase. In this case, Eq. (32) can be rearranged to obtain the asphaltene flocculation onset oil solubility parameter $\delta_{m,\ onset}$ at a given depth as:

$$\delta_{m,onset} = \delta_a - \left\{-\frac{RT}{v_a}\left[\ln\phi_a + 1 - \left(\frac{v_a}{v_m}\right)\right]\right\}^{1/2}. \tag{33}$$

In Eq. (33), the solubility parameter $\delta_a$ of the asphaltene solute part at the given depth can be derived from the temperature gradient relative to a reference measurement station as provided in Eq. (5) above. The reservoir temperature T can be derived from downhole fluid analysis (for example, by averaging the reservoir temperature measurements over multiple measurement stations). The partial molar volume $\upsilon_a$ for the asphaltene solute part is constant across the given depths of the reservoir and corresponds to the partial volume for asphaltene clusters. A spherical model of the form of Eq. (7) can be used to derive the partial molar volume $\upsilon_a$ for asphaltene clusters, where the molecular diameter d falls within a range of 4.0±0.5 nm for asphaltene clusters. The molar volume $v_m$ for the oil mixture at a given depth can be provided by the solution of the EOS model (step 211) or other suitable approach. In the preferred embodiment, the molar volume $v_m$ for the oil mixture at pressures below the saturation pressure is extrapolated from values for a single oil phase above the saturation pressure. The volume fraction $\phi_a$ of the asphaltene solute part at a given depth can be derived from the color measured by downhole fluid analysis at the given depth.

In the illustrative embodiment, the measured color at a given depth is related to the volume fraction $\phi_a$ of the asphaltene solute part at the given depth by an empirical relation of the form of Eq. (2). In the preferred embodiment, the empirical relation of Eq. (2) is tuned such that the volume fraction $\phi_a$ of the asphaltene solute part matches the solution of Eq. (33) at a particular depth $h_{onset}$ corresponding to the estimated reservoir pressure for asphaltene precipitation onset (e.g., the upper boundary of the APE) as measured by downhole fluid analysis described above. At this depth $h_{onset}$ and pressure, it is assumed that the asphaltene flocculation onset oil solubility parameter $\delta_{m,\ onset}$ matches the solubility parameter $\delta_a$ such that Eq. (33) can be rewritten as follows:

$$\phi_a = e^{\left(\frac{v_a}{v_m}-1\right)}. \tag{34}$$

This Eq. (34) can be solved utilizing the molar volume $v_m$ for the oil mixture at the depth $h_{onset}$ provided by the solution of the EOS model (step 211) or other suitable approach, together with the partial molar volume $\upsilon_a$ for the asphaltene solute part (clusters) as described above. The resultant volume fraction $\phi_a$ can be used to tune the empirical relation of Eq. (2). After tuning the empirical relation of Eq. (2), Eq. (33) can be used to derive the asphaltene flocculation onset oil solubility parameter $\delta_{m,\ onset}$ as a function of depth. The reservoir pressure for such depths can be derived from pressure measurements at multiple measurement stations by downhole fluid analysis together with interpolation using the linear relation of Eq. (3) above. Alternatively, the reservoir pressure for such depths can be derived from the output of the EOS modeling. The relation of the asphaltene flocculation onset oil solubility parameter $\delta_{m,\ onset}$ of the oil mixture to reservoir pressure can be derived by fitting a line to the asphaltene flocculation onset oil solubility parameter $\delta_{m,\ onset}$ and reservoir pressure value pairs at corresponding depths.

In step 305, the solubility parameter $\delta_m$ of the oil mixture as a function of reservoir pressure is compared to the asphaltene flocculation onset oil solubility parameter $\delta_{m,\ onset}$ as a function of pressure. If $\delta_m > \delta_{m,onset}$, then asphaltenes remain in the oil solution at the pressure. If $\delta_m < \delta_{m,onset}$, then asphaltenes flocculate from the oil mixture. A threshold condition or onset point for asphaltene flocculation exists if $\delta_m = \delta_{m,onset}$ (in other words, the solubility parameter $\delta_m$ of the oil mixture as a function of reservoir pressure intersects the asphaltene flocculation onset oil solubility parameter $\delta_{m,\ onset}$ as a function of pressure). If this threshold condition exists, the operations continue to steps 306-313; otherwise, the operations continue to step 317.

In step 306, because the threshold condition (or onset point for asphaltene flocculation) exists, the decision point of step 305 infers a likelihood of asphaltene instability in the reservoir fluids at a depth $h_{floc\text{-}onset\text{-}1}$, which corresponds to the pressure for the onset of asphaltene flocculation where $\delta_m = \delta_{m,onset}$. As the flocculation of asphaltene is typically a precursor to formation of phase-separated bitumen, the threshold condition of step 305 can effectively predict whether it is likely that phase-separated bitumen is present in the reservoir.

In step 307, live oil samples are collected by downhole fluid sampling at depths above, below, and at the depth $h_{floc\text{-}onset\text{-}1}$, if not done previously.

In step 309, laboratory (or downhole) fluid analysis is performed on the live oil samples collected in step 307 to verify the pressure (and possibly the corresponding depth $h_{floc\text{-}onset\text{-}1}$) of the asphaltene flocculation onset conditions as predicted in step 305. Such laboratory fluid analysis can involve gravimetric analysis, acoustic resonance technique, and light scattering techniques as described in Akbarzadeh et al., "Asphaltenes—Problematic but Rich in Potential," *Oilfield Review*, Summer 2007, pp. 22-43. Such analysis also verifies that the workflow is properly accounting for variations in the solubility parameter of asphaltenes at the onset of asphaltene flocculation.

In step 311, core samples are collected by core sampling at depths above, below, and at the depth $h_{floc\text{-}onset\text{-}1}$, if not done previously. The core samples can also be collected at depths where the flocculated asphaltenes are expected to concentrate and deposit. For example, asphaltene clusters can precipitate high in the oil column where gas is vertically charging into the reservoir from top to the bottom of the reservoir (or where gas is being injected into the reservoir from a fault plane). If the reservoir formation has high permeability that allows for diffusion of asphaltene clusters, the asphaltene clusters can migrate to and accumulate (concentrate) on the bottom of the permeable formation (e.g., at the oil-water contact). In the event that the solubility parameter of the oil mixture is (or becomes) less than the asphaltene flocculation onset oil solubility parameter, the concentrated asphaltene clusters at the bottom of the permeable formation flocculate and can form a tar mat at the bottom of the formation. On the other hand, if the reservoir formation has low permeability that prohibits diffusion of asphaltene clusters, the asphaltene clusters are expected to accumulate (concentrate), flocculate and deposit locally where the solubility parameter of the oil mixture is (or becomes) less than the asphaltene flocculation onset oil solubility parameter. In another example, asphaltene clusters can precipitate at the bottom of the oil column where gas is charging into the reservoir from the bottom to the top of the reservoir. In this scenario, the asphaltene clusters are expected to accumulate (concentrate), flocculate, and deposit locally where the solubility parameter of the oil mixture is (or becomes) less than the asphaltene flocculation onset oil solubility parameter.

In step 313, reservoir fluids are extracted from the core samples collected in step 311 and then subjected to laboratory analysis to investigate the presence of phase-separated bitumen in the core samples collected in step 311. Because phase-separated bitumen typically reduces permeability significantly even when found in only moderate amounts, the presence of phase-separated bitumen in the core samples is an important reservoir quality issue as it affects reserve calculations, recovery factors, and secondary recovery programs. Thus, all phases of oilfield exploitation (including exploration, development, and production) can be impacted by the presence of phase-separated bitumen. The laboratory analysis of step 313 can measure properties of the extracted reservoir fluids, such as density (API gravity). Density is typically measured by a hydrometer or an oscillating U-tube. Phase-separated bitumen generally has a density greater than 1 g/cc (API gravity less than 10°). It can be identified visually in core photographs (often taken with a microscope), or extracted from core samples by chemical means, such as a Soxhlet extractor, microwave, or accelerated solvent extractor.

In step 315, the results of steps 309 and 313 are evaluated to better understand the likelihood of asphaltene instability in the reservoir fluids at the depth $h_{floc\text{-}onset\text{-}1}$. For example, if the laboratory analysis of step 309 verifies the asphaltene flocculation onset conditions as predicted in step 305, the likelihood of asphaltene instability (flocculation) at or near the depth $h_{floc\text{-}onset\text{-}1}$ as predicted in step 305 can be strengthened. Moreover, if the laboratory analysis of step 313 identifies phase-separated bitumen in core samples, the workflow can identify the likely depth of deposition of the flocculated asphaltenes as the sampling location of the phase-separated bitumen-containing core samples. Following step 315, the workflow continues to step 359.

In step 317, the workflow derives the solubility parameter $\delta_m$ of the oil mixture as a function of depth in the reservoir. The solubility parameter $\delta_m$ for the oil mixture at a given depth can be derived from an empirical correlation to the density $\rho_m$ of the oil mixture at the given depth (for example, using the form of Eq. (3) above). The density $\rho_m$ of the oil mixture at a given depth can be measured by downhole fluid analysis (or laboratory analysis of the reservoir fluids collected from a given depth at reservoir conditions). It can also be derived from the output of the EOS model (step 205 or 209).

In step 319, the workflow derives the solubility parameter $\delta_{m,\,onset}$ of the oil at asphaltene flocculation onset conditions as a function of depth. The solubility parameter $\delta_{m,onset}$ at a given depth can be derived from Eq. (33) as described above with respect to step 303, where it is assumed that the reservoir is isometric at a given temperature T. The reservoir temperature T can be derived from downhole fluid analysis (for example, by averaging the reservoir temperature measurements over multiple measurement stations). The partial molar volume $\upsilon_a$ for the asphaltene solute part is constant across the given depths of the reservoir and corresponds to the partial volume for asphaltene clusters. A spherical model of the form of Eq. (7) can be used to derive the partial molar volume $\upsilon_a$ for asphaltene clusters, where the molecular diameter d falls within a range of 4.0±0.5 nm for asphaltene clusters. The molar volume $v_m$ for the oil mixture at a given depth can be provided by the solution of the EOS model (step 211) or other suitable approach. The volume fraction $\phi_a$ of the asphaltene solute part at a given depth can be derived from the color measured by downhole fluid analysis at the given depth as described above.

In step 321, the solubility parameter $\delta_m$ as a function of depth is compared to the asphaltene flocculation onset oil solubility parameter $\delta_{m,onset}$ as a function of depth. If $\delta_m>\delta_{m,onset}$, then asphaltenes remain in the oil solution at the pressure. If $\delta_m<\delta_{m,onset}$, then asphaltenes flocculate from the oil mixture. A threshold condition or onset point for asphaltene flocculation exists if $\delta_m=\delta_{m,onset}$ (in other words, the solubility parameter $\delta_m$ of the oil mixture as a function of depth intersects the asphaltene flocculation onset oil solubility parameter $\delta_{m,\,onset}$ as a function of depth). If this threshold condition exists, the operations continue to steps 322-331; otherwise, the operations continue to step 333.

In step 322, because the threshold condition (or onset point for asphaltene flocculation) exists, the decision point of step 321 infers a likelihood of asphaltene instability in the reservoir fluids at a depth $h_{floc\text{-}onset\text{-}2}$, which is the depth for the onset of asphaltene flocculation where $\delta_m=\delta_{m,onset}$. As the flocculation of asphaltene is typically a precursor to the formation of phase-separated bitumen, the threshold condition of step 321 can effectively predict whether it is likely that phase-separated bitumen is present in the reservoir.

In step 323, live oil samples are collected by downhole fluid sampling at depths above, below, and at the depth $h_{floc\text{-}onset\text{-}2}$, if not done previously.

In step 325, laboratory fluid analysis is performed on the live oil samples collected in step 323 in order to verify the depth $h_{floc\text{-}onset\text{-}2}$ (and possibly corresponding measured reservoir pressure) of the asphaltene flocculation onset conditions as predicted in step 321. Such laboratory fluid analysis can involve gravimetric analysis, acoustic resonance technique, and light scattering techniques as described in Akbarzadeh et al., "Asphaltenes—Problematic but Rich in Potential," *Oilfield Review*, Summer 2007, pp. 22-43. Such analysis also verifies that the workflow is properly accounting for variations in the solubility parameter of asphaltenes at the onset of asphaltene flocculation.

In step 327, core samples are collected by core sampling at depths above, below, and at the depth $h_{floc\text{-}onset\text{-}2}$, if not done previously. The core samples can also be collected at depths where the flocculated asphaltenes are expected to concentrate and deposit. For example, asphaltene clusters can precipitate high in the oil column where gas is vertically charging into the reservoir from the top to the bottom of the reservoir (or where gas is being injected into the reservoir from a fault plane). If the reservoir formation has high permeability that allows for diffusion of asphaltene clusters, the asphaltene clusters can migrate to and accumulate (concentrate) on the bottom of the permeable formation (e.g., at the oil-water contact). In the event that the solubility parameter of the oil mixture is (or becomes) less than the asphaltene flocculation onset oil solubility parameter, the concentrated asphaltene clusters at the bottom of the permeable formation flocculate and can form a tar mat at the bottom of the formation. On the other hand, if the reservoir formation has low permeability that prohibits diffusion of asphaltene clusters, the asphaltene clusters are expected to accumulate (concentrate), flocculate, and deposit locally where the solubility parameter of the oil mixture is (or becomes) less than the asphaltene flocculation onset oil solubility parameter. In another example, asphaltene clusters can precipitate at the bottom of the oil column where gas is charging into the reservoir from the bottom to the top of the reservoir. In this scenario, the asphaltene clusters are expected to accumulate (concentrate), flocculate, and deposit locally where the solubility parameter of the oil mixture is (or becomes) less than the asphaltene flocculation onset oil solubility parameter.

In step 329, reservoir fluids are extracted from the core samples collected in step 327 and then subjected to laboratory analysis to investigate the presence of phase-separated bitumen in the core samples collected in step 327. Because phase-separated bitumen typically reduces permeability significantly even when found in only moderate amounts, the presence of phase-separated bitumen in the core samples is an important reservoir quality issue as it affects reserve calculations, recovery factors, and secondary recovery programs. Thus, all phases of oil field exploitation (including exploration, development, and production) can be impacted by the presence of phase-separated bitumen. The laboratory analysis of step 329 can measure properties of the extracted reservoir fluids, such as density (API gravity).

In step 331, the results of steps 325 and 329 are evaluated to better understand the likelihood of asphaltene instability in the reservoir fluids at the depth $h_{floc\text{-}onset\text{-}2}$. For example, if the laboratory analysis of step 325 verifies the asphaltene flocculation onset conditions as predicted in step 321, the likelihood of asphaltene instability (flocculation) at or near the depth $h_{floc\text{-}onset\text{-}2}$ as predicted in step 321 can be strengthened. Moreover, if the laboratory analysis of step 329 identifies phase-separated bitumen in core samples, the workflow can identify the likely depth of deposition of the flocculated asphaltenes as the sampling location of the phase-separated bitumen-containing core samples. Following step 331, the workflow continues to step 359.

In step 333, the depth(s) of asphaltene precipitation onset conditions (e.g., the upper boundary of the APE) can be estimated by downhole fluid analysis at multiple measurement stations. More specifically, the downhole fluid analysis tool can sample the reservoir fluids at a given measurement location and measure the pressure for asphaltene precipitation onset conditions for the given measurement station as described above. The downhole fluid analysis tool can also measure reservoir pressure at the given measurement station. If the measured reservoir pressure matches or exceeds the pressure for asphaltene precipitation onset conditions, the depth of the given measurement station can be used as an estimate for the depth of asphaltene precipitation onset conditions.

In step 335, it is determined if the operations of step 333 identified asphaltene precipitation onset conditions at any depth. If so, the operations continue to step 337; otherwise the operations continue to step 361.

In step 337, the workflow estimates GOR as a function of depth. Preferably, the estimate of GOR as a function of depth is derived from linear interpolation of GOR measurements made by downhole fluid analysis at multiple measurement stations using the linear relation of Eq. (4) above.

In step 339, an EOS model is used to predict GOR as a function of depth, if not done previously (step 205 or 209).

In step 341, the estimate of GOR as a function of depth from step 337 is compared to the prediction of GOR as a function of depth from step 339 in order to identify one or more depth intervals where there are abnormal differences in the estimated GOR as compared to the predicted GOR.

In step 343, the workflow derives solubility parameter $\delta_m$ of the oil mixture for depths within the depth interval(s) identified in step 341. The solubility parameter $\delta_m$ for the oil mixture at a given depth can be derived from an empirical correlation to the density $\rho_m$ of the oil mixture at the given depth (for example, using the form of Eq. (3) above). The density $\rho_m$ of the oil mixture at a given depth can be measured by downhole fluid analysis (or laboratory analysis of the reservoir fluids collected from a given depth at reservoir conditions). It can also be derived from the output of the EOS model (step 205 or 209).

In step 345, the workflow derives estimates of the concentration of asphaltenes (clusters) for depths within the depth interval(s) identified in step 341. In the preferred embodiment, such estimates of asphaltene (cluster) concentration are based on an empirical relation (Eq. (1)) to downhole fluid measurements (color) at multiple measurement stations.

Next, the operations continue to steps 349-357. In step 349, live oil samples are collected by downhole fluid sampling at depths within the particular depth interval that satisfies the conditions of step 341 (and possibly at depths above and/or below such particular depth interval), if not done previously.

In step 351, laboratory fluid analysis is performed on the live oil samples collected in step 349 in order to verify the depth of the asphaltene flocculation onset conditions as predicted in step 341. Such laboratory fluid analysis can involve gravimetric analysis, acoustic resonance technique, and light scattering techniques as described in Akbarzadeh et al., "Asphaltenes—Problematic but Rich in Potential," *Oilfield Review*, Summer 2007, pp. 22-43. Such analysis also verifies that the workflow is properly accounting for variations in the solubility parameter of asphaltenes at the onset of asphaltene flocculation.

In step 353, core samples are collected by core sampling at depths within the particular depth interval that satisfies the condition of step 341 (and possibly at depths above and/or below such particular depth interval), if not done previously. The core samples can also be collected at depths where the flocculated asphaltenes are expected to concentrate and deposit. For example, asphaltene clusters can precipitate high in the oil column where gas is vertically charging into the reservoir from the top to the bottom of the reservoir (or where gas is being injected into the reservoir from a fault plane). If the reservoir formation has high permeability that allows for diffusion of asphaltene clusters, the asphaltene clusters can migrate to and accumulate (concentrate) on the bottom of the permeable formation (e.g., at the oil-water contact). In the event that the solubility parameter of the oil mixture is (or becomes) less than the asphaltene flocculation onset oil solubility parameter, the concentrated asphaltene clusters at the bottom of the permeable formation flocculate and can form a tar mat at the bottom of the formation. On the other hand, if the reservoir formation has low permeability that prohibits diffusion of asphaltene clusters, the asphaltene clusters are expected to accumulate (concentrate), flocculate, and deposit locally where the solubility parameter of the oil mixture is (or becomes) less than the asphaltene flocculation onset oil solubility parameter. In another example, asphaltene clusters can precipitate at the bottom of the oil column where gas is charging into the reservoir from the bottom to the top of the reservoir. In this scenario, the asphaltene clusters are expected to accumulate (concentrate), flocculate, and deposit locally where the solubility parameter of the oil mixture is (or becomes) less than the asphaltene flocculation onset oil solubility parameter.

In step 355, reservoir fluids are extracted from the core samples collected in step 353 and then subjected to laboratory analysis to investigate the presence of phase-separated bitumen in the core samples collected in step 353. Because phase-separated bitumen typically reduces permeability significantly even when found in only moderate amounts, the presence of phase-separated bitumen in the core samples is an important reservoir quality issue as it affects reserve calculations, recovery factors, and secondary recovery programs. Thus, all phases of oil field exploitation (including exploration, development, and production) can be impacted by the presence of phase-separated bitumen. The laboratory analysis of step 355 can measure properties of the extracted reservoir fluids, such as density (API gravity).

In step 357, the results of steps 351 and 355 are evaluated to better understand the likelihood of asphaltene instability in the reservoir fluids at or near the particular depth interval identified in step 341. For example, if the laboratory analysis of step 351 verifies asphaltene flocculation onset conditions at or near the particular depth interval identified in step 341, the likelihood of asphaltene instability (flocculation) at or near the particular depth interval can be strengthened. Moreover, if the laboratory analysis of step 355 identifies phase-separated bitumen in core samples, the workflow can identify the likely depth of deposition of the flocculated asphaltenes as the sampling location of the phase-separated bitumen-containing core samples. Following step 357, the workflow continues to step 359.

In step 359, the workflow can perform additional analyses to characterize properties of the phase-separated bitumen in the reservoir, such as bitumen solubility, volume of bitumen, and distribution of bitumen in the reservoir. Such properties are typically characterized by geochemical analyses that can include: separation of compound class fractions (saturated hydrocarbons, aromatic hydrocarbons, asphaltenes, and resins), elemental analysis, mass spectroscopy, x-ray spectroscopy, NMR spectroscopy, pyrolysis, and microscopic/reflectance analysis.

In step 361, the workflow can perform additional analysis in order to investigate the distribution of asphaltenes (clusters) in the reservoir and the fluid properties and mechanisms that relate to formation and deposition of asphaltenes (clusters) in the reservoir in order to better understand the reservoir.

Following steps 359 and 361, the workflow for investigating asphaltene instability ends.

Advantageously, the workflow of the present invention provides operations that effectively detect conditions that lead to phase-separated bitumen formation and thus predict the presence of phase-separated bitumen in the reservoir. The method of the present invention allows for efficient identification of the presence of phase-separated bitumen in the reservoir, and thus can lead to optimizations and efficiencies in the development of the reservoir.

There has been described and illustrated herein a preferred embodiment of a method for downhole fluid analysis of the fluid properties of a reservoir of interest and for characterizing the reservoir of interest based upon such downhole fluid analysis. While particular embodiments of the invention have been described, it is not intended that the invention be limited thereto, as it is intended that the invention be as broad in scope as the art will allow and that the specification be read likewise. Thus, while particular equation of state models, solubility models, and applications of such models have been disclosed for predicting properties of reservoir fluid, it will be appreciated that other predictive models and applications thereof could be used as well. Moreover, the methodology described herein is not limited to stations in a vertical wellbore or in the same wellbore. For example, the workflow as described herein can be used to investigate wellbores with horizontal sections. In another example, measurements from samples from different wells can be analyzed as described herein for testing for lateral connectivity. In addition, the workflow as described herein can be modified. For example, it is contemplated that user input can select the solute type classes from a list of solute type classes for processing. The user might also be able to specify certain parameters for the processing, that are used as input to the equation of state model to derive concentration curves for the relevant solute part classes as well as optical density wavelengths that are used to correlate to concentrations measured by downhole fluid analysis. It will therefore be appreciated by those skilled in the art that yet other modifications could be made to the provided invention without deviating from its scope as claimed.

What is claimed is:

1. A method for identifying instability of asphaltene in petroleum fluid within a reservoir traversed by at least one wellbore, the method comprising:

(a) at a plurality of measurement stations within the at least one wellbore, acquiring at least one fluid sample at the respective measurement station and performing downhole fluid analysis of the fluid sample to derive properties of the petroleum fluid of the reservoir as a function of location in the reservoir, wherein the properties of the petroleum fluid derived in (a) include concentration of an asphaltene fraction, the petroleum fluid comprises a solute part and a solvent part, and the solvent part comprises a bulk reservoir fluid;

(b) deriving values of a first parameter characterizing solubility of the petroleum fluid for different locations or pressures in the reservoir, wherein the values of the first parameter characterize solubility of the bulk reservoir fluid as a function of pressure or depth in the reservoir;

(c) generating values of a second parameter characterizing fluid properties of the petroleum fluid for different locations or pressures in the reservoir, wherein the values of the second parameter are based upon concentration of the asphaltene fraction derived in (a), and wherein the values of the second parameter characterize solubility of the bulk reservoir fluid at the onset of flocculation of the asphaltene fraction as a function of pressure or depth in the reservoir; and (d) evaluating the values of the first parameter derived in (b) and the values of the second parameter generated in (c) in order to identify a location where onset of flocculation of the asphaltene fraction is likely, wherein the evaluating of (d) equates the location where the onset of flocculation of the asphaltene fraction is likely to the location at a pressure or the depth where the value of the first parameter matches the value of the second parameter.

2. The method according to claim 1, wherein the first parameter characterizes solubility of the bulk reservoir fluid.

3. The method according to claim 2, wherein the value of the first parameter for a given location is calculated from the density of the bulk reservoir fluid at the given location.

4. The method according to claim 3, wherein:

the value of the first parameter for the given location is derived from an empirical correlation to density of the bulk reservoir fluid at the given location of a form $$\delta_m = 17.347\rho_m + 2.904,$$

where $\rho_m$ is the density of the bulk reservoir fluid at the given location in g/cc, and $\delta_m$ is the first parameter at the given location in $MPa^{0.5}$.

5. The method according to claim 3, wherein the density of the bulk reservoir fluid at the given location is measured by one of downhole fluid analysis and/or laboratory analysis of the reservoir fluids collected from the given location.

6. The method according to claim 3, wherein the density of the bulk reservoir fluid at the given location is derived from output of an EOS model.

7. The method according to claim 1, wherein the second parameter characterizes solubility of the bulk reservoir fluid at the onset of flocculation of the asphaltene fraction.

8. The method according to claim 7, wherein the value of the second parameter for a given location is based upon a number of predetermined properties of the reservoir fluid at the given location, the predetermined properties including the volume fraction of the asphaltene fraction, the partial molar volume of the asphaltene fraction, and the molar volume of the bulk reservoir fluid.

9. The method according to claim 8, wherein:

the value of the second parameter for the given location is derived from the relation $$\delta_{m,onset} = \delta_a - \left\{-\frac{RT}{v_a}\left[\ln\phi_a + 1 - \left(\frac{v_a}{v_m}\right)\right]\right\}^{1/2},$$

where $\phi_a$ is the volume fraction of the asphaltene fraction at the given location, $\upsilon_a$ is the partial molar volume for the asphaltene fraction at the given location, $\upsilon_m$ is the molar volume for the bulk reservoir fluid at the given location, $\delta_a$ is the solubility parameter for the asphaltene fraction at the given location, R is the universal gas constant, and T is the absolute temperature of the reservoir fluid.

10. The method according to claim 9, wherein $\delta_a$ at the given location is derived from a temperature gradient relative to a reference measurement station.

11. The method according to claim 9, wherein $\upsilon_a$ is constant across reservoir locations and is given by a spherical model based on molecular diameter for the asphaltene fraction.

12. The method according to claim 9, wherein $v_m$ for the given location is provided by the solution of an EOS model.

13. The method according to claim 9, wherein $\phi_a$ for the given location is calculated from an empirical relation relating $\phi_a$ to color measured by downhole fluid analysis.

14. The method according to claim 13, wherein the empirical relation relating $\phi_a$ to color measured by downhole fluid analysis is tuned such that $\phi_a$ matches a solution at a particular location corresponding to estimated reservoir pressure for asphaltene precipitation onset as measured by downhole fluid analysis.

15. The method according to claim 14, wherein:

the solution is given by $$\phi_a = e^{\left(\frac{v_a}{v_m}-1\right)},$$

where $\upsilon_a$ is the partial molar volume for the asphaltene fraction at the given location, and $\upsilon_m$ is the molar volume for the bulk reservoir fluid at the given location.

16. The method according to claim 7, wherein the asphaltene fraction comprises asphaltene clusters; and the value of the second parameter for a given location is based upon the partial molar volume of asphaltene clusters.

17. The method according to claim 16, wherein the partial molar volume of asphaltene clusters is derived from a molecular diameter of asphaltene clusters in a range between 3.5 nm and 4.5 nm.

18. The method according to claim 16, wherein the value of the second parameter for a given location is further based upon concentration of asphaltene clusters as measured by downhole fluid analysis.

19. The method according to claim 1, further comprising:

generating values of a third parameter characterizing fluid properties of the petroleum fluid for different locations or pressures in the reservoir;

wherein the evaluating of (d) evaluates the values of the first parameter, the values of the second parameter, and the values of the third parameter in order to identify locations where onset of flocculation of the asphaltene fraction is likely.

20. The method according to claim 19, wherein:

the values of the first parameter characterize solubility of the bulk reservoir fluid as a function of depth in the reservoir;

the values of the second parameter characterize concentration of the asphaltene fraction of the reservoir fluid as a function of depth in the reservoir; and the values of the third parameter characterize GOR of the reservoir fluid as a function of depth in the reservoir.

21. The method according to claim 1, wherein the evaluating of (d) is part of a workflow decision point for selectively performing additional analysis of reservoir fluids.

22. The method according to claim 21, wherein the additional analysis of reservoir fluids is adapted to verify that the onset of flocculation of the asphaltene fraction is likely at the location identified in (d).

23. The method according to claim 22, wherein the additional analysis of reservoir fluids includes collection of live fluid samples at or near the particular location identified in (d).

24. The method according to claim 22, wherein the additional analysis of reservoir fluids includes laboratory and/or downhole analysis of fluid samples to verify pressure conditions for the onset of flocculation of the asphaltene fraction at the particular location identified in (d).

25. The method according to claim 21, wherein the additional analysis of reservoir fluids includes the collection of core samples.

26. The method according to claim 21, wherein the additional analysis of reservoir fluids includes laboratory analysis of core samples to identify the presence of bitumen in the core samples.

27. The method according to claim 21, wherein the additional analysis of reservoir fluids includes laboratory analysis that characterizes properties of bitumen in core samples.

28. The method according to claim 1, further comprising:

(e) utilizing at least one predictive model to derive a predicted concentration of the asphaltene fraction as a function of location in the reservoir, wherein the predictive model assumes an equilibrium distribution of the asphaltene fraction as a function of location in the reservoir; and (f) comparing the predicted concentration of the asphaltene fraction as a function of location as generated in (e) to the measured concentration of the asphaltene fraction as a function of location as derived in (a) to determine if such asphaltene fraction concentrations match one another.

29. The method according to claim 28, wherein step (d) is performed only if it is determined that such asphaltene fraction concentrations match one another in step (f).

30. The method according to claim 28, wherein the at least one predictive model includes an equation of state model that characterizes relative concentrations of the asphaltene fraction as a function of depth as related to relative solubility, density, and molar volume of the asphaltene fraction at varying depth.

31. The method according to claim 30, wherein the equation of state model treats the reservoir fluid as a mixture of two parts, the two parts being a solute part and a solvent part, the solute part comprising the asphaltene fraction and the solvent part comprising the bulk reservoir fluid.

32. The method according to claim 31, wherein:

the equation of state model is based on a mathematical relationship of the form $$\frac{\phi_a(h_2)}{\phi_a(h_1)} = \exp\left\{\frac{v_a g(\rho_m - \rho_a)(h_2 - h_1)}{RT} + \left(\frac{v_a}{v_m}\right)_{h_2} - \left(\frac{v_a}{v_m}\right)_{h1} - \frac{v_a\left[(\delta_a - \delta_m)^2_{h_2} - (\delta_a - \delta_m)^2_{h_1}\right]}{RT}\right\}$$

where $\phi_a(h_1)$ is the volume fraction for the solute part at depth $h_1$, $\phi_a(h_2)$ is the volume fraction for the solute part at depth $h_2$, $\upsilon_a$ is the partial molar volume for the solute part, $\upsilon_m$ is the molar volume for the solvent part, $\delta_a$ is the solubility parameter for the solute part, $\delta_m$ is the solubility parameter for the solvent part, $\rho_a$ is the partial density for the solute part, $\rho_m$ is the density for the solvent part, R is the universal gas constant, and T is the absolute temperature of the reservoir fluid.

33. The method according to claim 30, wherein the at least one predictive model further includes an EOS model.

34. The method according to claim 1, wherein the asphaltene fraction comprises asphaltene clusters.

* * * * *